US007868842B2

(12) United States Patent
Chair

(10) Patent No.: US 7,868,842 B2
(45) Date of Patent: Jan. 11, 2011

(54) BASE STATION ANTENNA WITH BEAM SHAPING STRUCTURES

(75) Inventor: Ricky Chair, Phoenix, AZ (US)

(73) Assignee: Amphenol Corporation, Wallingford, CT (US)

( * ) Notice: Subject to any disclaimer, the term of this patent is extended or adjusted under 35 U.S.C. 154(b) by 289 days.

(21) Appl. No.: 12/251,675

(22) Filed: Oct. 15, 2008

(65) Prior Publication Data

US 2009/0096700 A1 Apr. 16, 2009

Related U.S. Application Data

(60) Provisional application No. 60/979,874, filed on Oct. 15, 2007.

(51) Int. Cl.
*H01Q 21/20* (2006.01)

(52) U.S. Cl. ..... 343/797

(58) Field of Classification Search ..... 343/797, 343/792–795; 455/15, 276.1
See application file for complete search history.

(56) References Cited

U.S. PATENT DOCUMENTS 3,747,114 A * 7/1973 Shyhalla ..... 343/795
5,039,994 A * 8/1991 Wash et al. ..... 343/813
6,198,434 B1 * 3/2001 Martek et al. ..... 342/373
6,512,487 B1 * 1/2003 Taylor et al. ..... 343/795
6,583,760 B2 * 6/2003 Martek et al. ..... 342/373
6,864,853 B2 * 3/2005 Judd et al. ..... 343/844
2004/0110469 A1 6/2004 Judd et al.
2004/0156301 A1 8/2004 Ikenaka
2005/0196176 A1 9/2005 Sun et al.

* cited by examiner

*Primary Examiner*—Huedung Mancuso
(74) *Attorney, Agent, or Firm*—Blank Rome LLP

(57) ABSTRACT

A dual polarization base station antenna producing a beam having 3 dB azimuth beamwidth of E(theta) within 5° of the 3 dB azimuth beamwidth of E(phi). The antenna also maintains E(theta) and E(phi) within 3 dB of each other over a wide beamwidth up to 120°, and over a wide bandwidth of 30% of the center frequency. The antenna achieves these performance characteristics through beam shaping structures connected to or located near the ground plane supporting the dipole antenna elements. By adjusting the locations and shapes of the beam shaping structures, specific antennas are designed to meet these design characteristics for different desired beamwidths, including 45°, 60°, 90° and 120°.

15 Claims, 18 Drawing Sheets

| Azimuth Beamwidth | d | h |
|---|---|---|
| 45° | $1.04\lambda_0$ | $0.22\lambda_0$ |
| 65° | $0.74\lambda_0$ | $0.22\lambda_0$ |
| 85° | $0.57\lambda_0$ | $0.26\lambda_0$ |
| 90° | $0.52\lambda_0$ | $0.30\lambda_0$ |
| 120° | $0.52\lambda_0$ | $0.39\lambda_0$ |

BASE STATION ANTENNA WITH BEAM SHAPING STRUCTURES

REFERENCE TO RELATED APPLICATION

This application claims filing priority to commonly owned U.S. Provisional Patent Application Ser. No. 60/979,874, entitled "Dual Polarized Array Antenna" filed Oct. 15, 2007, which is incorporated herein by reference.

TECHNICAL FIELD

The present invention pertains to the field of telecommunication antennas and, more particularly, to a base station antenna for a wireless telecommunication system that includes beam shaping structures that control the shape of the beam emitted by the antenna.

BACKGROUND

Diversity techniques are widely used in wireless communications to improve the signal performance. Spatial diversity typically uses two or more antennas spatially separated. The system performance is generally limited by the cross-correlation coefficient between the two spatially diversified antennas. The optimum performance occurs only when the cross-correlation coefficient approaches zero.

Polarization diversity provides an alternative to spatial diversity for base station communications. It has been widely used in cellular system (GSM), Personal Communications Services (PCS), and more recent systems including advanced wireless service (AWS) and WiMax. In actual communication systems, signals encounter multi-path propagation and multiple reflections, which cause depolarization of the signal. As a result, the antenna at the base station need not be aligned with vertical linear polarization. A dual polarization base station antenna creates two branches by using an antenna with dual simultaneous polarizations oriented orthogonally to each other. In general, the two branches of the dual polarization base station antennas are implemented by planar radiating elements slanted at +45° and −45° with respect to the main axis of the antenna. For each branch, the slant 45° polarized antenna signals may be represented by two polarization components, one polarization component that is vertical and the other that is horizontal, namely E(theta) and E(phi), respectively. The slanting angle (θ) of the radiating element depends on the E(theta) and E(phi), $$\theta = \pm\tan\frac{E_{phi}}{E_{theta}} \tag{1}$$

Theoretically, E(theta) and E(phi) need to maintain the same power across an azimuth (typically horizontal) cut in order to provide an effective performance for a wireless base station site with perfectly slanted ±45° dual polarized fields over the field of view of the antenna. The ideal antenna transmission pattern has substantially rotationally symmetric E(theta) and E(phi) radiation patterns along a typical 120° sector coverage with E(theta) equal to E(phi) over the entire range. In reality, prior art base station antennas are not able to maintain E(theta) and E(phi) within 3 dB of each other over an azimuth range equal to 120° sector coverage. In addition, an ideal antenna performance would maintain E(theta) and E(phi) equal to each other over the entire applicable bandwidth, which typically covers a 30% range from about from 85% to about 115% of the center frequency. Again, in reality, prior art base station antennas are not able to maintain E(theta) and E(phi) within 3 dB of each other over a 30% bandwidth as well as over a 120° azimuth range.

In the wireless communication industry, base station antennas with different azimuth beamwidths are required by many operators. The azimuth beamwidths range between 18° and 120°. With a dipole, the azimuth beamwidth can be easily achieved below 65°. Multiple columns of dipoles with predetermined power distribution can achieve azimuth beamwidths as low as 18° with both E(theta) and E(phi) exhibiting similar signal strength along the 3 dB beamwidth coverage. For azimuth beamwidth above 65°, however, the E(phi) 3 dB beamwidth is limited to around 70° due to the nature of the dipole. In order to achieve wider azimuth beamwidth, the prior solution has been to increase the beamwidth of the E(theta). With this technique, the antenna loses the rotationally symmetric radiation patterns, and the slant 45° dipole leans to a smaller slanting angle based on the differences between E(theta) and E(phi) as described by equation (1), which causes the dual polarized dipoles to no longer be orthogonal to each other. As a result, the communication performance drops near the edge of the cell, potentially causing more dropped calls between the mobile unit and the base station.

Runyon, U.S. Pat. No. 6,067,053, describes a dipole antenna element with drooped dipole arms that can improve the radiation pattern performance by increasing the E(phi) 3 dB beamwidth to more than 70°. However, the matching bandwidth of the droop arm dipole is limited by its nature to less than 10% to fit the PCS frequency band from 1850-1990MHz, equivalent to seven percent of the center frequency. As a result, the beam pattern performance is limited to the PCS frequency band for which the dipole was designed. In general, prior art dual polarization base station antennas have not been able to achieve beam pattern performance with the E(theta) and E(phi) 3 dB beamwidths within 5° of each other, while maintaining E(theta) and E(phi) within 3 dB of each other over a wide beamwidth, such as 120°, and over a wide bandwidth, such as 30% of the center frequency.

As a result, there is an ongoing need for dual polarization base station antennas with improved E(theta) and E(phi) beam pattern performance characteristics. In particular, there is an ongoing need for dual polarization base station antennas that can achieve beam pattern performance with the E(theta) and E(phi) 3 dB beamwidths within 5° of each other, while maintaining E(theta) and E(phi) within 3 dB of each other over a wide beamwidth, such as 120°, and over a wide bandwidth, such as 30% of the center frequency

SUMMARY OF THE INVENTION

The present invention meets the needs described above in dual polarization base station antennas that produce beams in which the 3 dB azimuth beamwidth of the vertical polarization component E(theta) is within 5° of the 3 dB azimuth beamwidth of the horizontal polarization E(phi). The antenna also maintains E(theta) and E(phi) within 3 dB of each other over a wide azimuth beamwidth up to 120°, and over a wide bandwidth up to 30% of the center frequency. The antenna achieves these performance characteristics through the use of beam shaping structures connected to or located near the ground plane supporting the dipole antenna elements. By adjusting the locations and shapes of the beam shaping structures, specific antennas are designed to meet the desired performance characteristics, including maintaining the 3 dB bandwidths of E(theta) and E(phi) within 5° of each other while maintaining E(theta) and E(phi) within 3 dB of each other, for a variety of beamwidths up to 120°, while meeting these performance characteristics over a wide bandwidth up to 30% of the center frequency.

It should also be understood that many other advantages and alternatives for practicing the invention will become apparent from the following detailed description of the preferred embodiments and the appended drawings.

BRIEF DESCRIPTIONS OF THE DRAWINGS

DETAILED DESCRIPTION OF INVENTION

Figure 1:
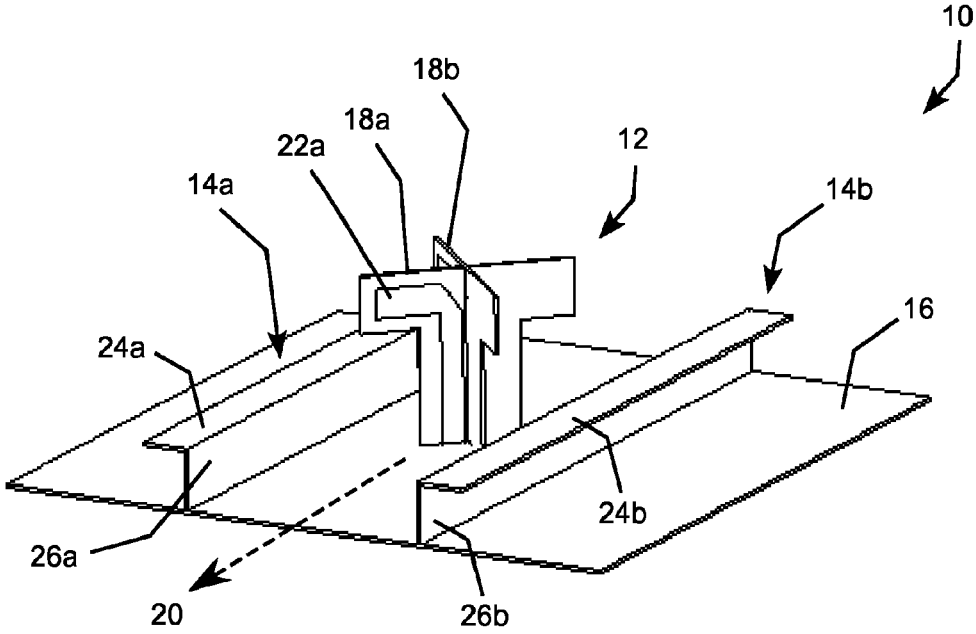
FIG. 1 is perspective view of a portion of a base station antenna showing one dipole antenna element and beam shaping structures connected to a ground plane.

The present invention may be embodied in a wide range of dual polarization antennas with one or more arrays of dipole antenna elements and one or more beam shaping structures designed to confer desired vertical polarization E(theta) and horizontal polarization E(phi) beamwidth and bandwidth characteristics. For example, the invention may be embodied in a single-band antenna elements with one array of dipole antennas and one arrangement of beam shaping structures, a dual-band antenna with two arrays of dipole antenna elements and two arrangements of beam shaping structures, a triple-band antennas with three arrays of dipole antenna elements and three arrangements of beam shaping structures, and so forth. The beam shaping structures are typically implemented as a pair of inverted-L shaped flange sections connected to the ground plane running the length of the associated array with one beam shaping channel located on each side of the antenna array. The flange sections may be electrically connected to the ground plane or electrically floating from ground, as desired. Alternatively, the beam shaping structures for an array may be implemented as a tray defined into the ground plane or antenna housing supporting the array. In either case, the beam shaping structures are located sufficiently near the antenna elements and the ground plane to significantly influence the currents flowing on the ground plane. This places the beam shaping structures into the antenna's electromagnetic field very near the dipole antenna elements in order to impart the desired beam shaping effect.

The base station antenna with dual polarized radiating elements and beam shaping surfaces generates substantially rotationally symmetric radiation patterns in the forward azimuth plane. Each dipole antenna element includes two radiating elements that are orthogonal to each other and slanted at ±45° to the main antenna axis. One or more arrays of dipole antenna elements run along or parallel to the main antenna axis. The size of the antenna elements of each array depends on the operational frequency of array and the antenna elements are spaced apart by a predetermined distance based on the operational frequency of the array. A conductive ground plane is positioned below the radiating elements with the cross members of the generally "T" shaped radiating elements at a predetermined distance above the ground plane, which is also based on the operational frequency of the array.

An antenna feed system such as a beam forming network, which can be a variable phase shifter network or fixed phase network, connected to the radiating elements is typically attached to the back side of the ground plane or the antenna enclosure behind the ground plane. For a vertically oriented antenna mounted in the usual configuration on a tower or building, the beam forming network is designed to deliver different power and phase to the radiating elements to control the vertical (elevation) radiation patterns, focus the beam in elevation, and tilt the beam in elevation (typically toward the ground), as desired.

The preferred beam shaping structures, which control the horizontal (azimuth) radiation pattern, include a pair of conductive beam shapers with two surfaces in an inverted-L configuration, with one structure positioned normal to the ground plane and the other structure positioned parallel to the ground plane and spaced apart from the ground plane at a predetermined distance. The beam shaping structures may be formed by an inverted-L shaped channel extending the length of the antenna array supported by the ground plane. Alternatively, the beam shaping structures may be trays formed into the ground plane, which may be part of the antenna enclosure. As another alternative, the beam shaper can be an inverted-L shaped section or a flat conductive strip spaced apart from the ground plane running parallel to the antenna array along the length of the array. The beam shaping structures reduce current flowing on the ground plane and generate more symmetrical and matched azimuth radiation patterns for E(theta and E(phi) over a broad range of beamwidth and frequency range, and also improve the front-to-back ratio of the antenna.

For the specific antennas shown in the figures, the beam shaper produces antenna patterns having 3 dB azimuth beamwidths between the vertical polarization E(theta) and horizontal polarization E(phi) field components that are less than 5°. That is, the 3 dB drop points defining the azimuth beamwidth of the vertical polarization component E(theta) is within 5° of the 3 dB drop points defining the azimuth beamwidth of the horizontal polarization E(phi). In addition, the polarization gain differential between E(theta) and E(phi) at any value over the 3 dB azimuth field of view for the antenna is less than 3 db, and typically less than 2 dB. Further, these E(theta) and E(phi) performance characteristics are achieved over a wide bandwidth up to 30% of the center frequency.

Generally, the objectives achieved by the antennas with beam shaping structures include substantially rotationally symmetric radiation patterns E(phi) and E(theta) having 3 dB drop points defining the azimuth beamwidths that do not vary from each other by more than 5°; and E(phi) and E(theta) fields that do not vary from each other by more than 3 dB over the azimuth beamwidth of the antenna up to 120° and over a bandwidth range up to 30% of the center frequency. The beam shaper can be a right angle inverted-L shape with two conducting surface, one that is parallel to the ground plane and the other surface that is normal to the ground plane running parallel to the antenna array along the length of the array. The beam shaper can alternatively be a vertical wall formed by a tray in the ground plane extending parallel to the antenna array along the length of the array. As another alternative, the beam shaper can be a flat strip normal to or spaced apart from the ground plane and running parallel to the antenna array along the length of the array. Thus, the beam shaper can be a separate structure connected to or held above the ground plane, or it can be integrally formed into the ground plane. The beam shaping structures are conductive, typically formed of aluminum. Although other conductive materials may be used, aluminum has desirable conductivity, weight, strength, formability, and corrosion resistance properties.

Illustrative antennas can operate in a frequency range up to 30% of the center frequency while maintaining the polarization gain differential between E(phi) and E(theta) not more than 3 dB across the azimuth beamwidth. Example beam shapers create antennas emitting beams having azimuth beamwidth from 45° to 120° with different "d" and "h" design characteristics (see FIG. 10). The beam shaper also improves the front-to-back ratio of the antenna up to about 5 dB. The antennas have substantially orthogonal polarization states that minimize the cross-polarization response. The dual polarization states may have electric centers that are co-located within the antennas system, or they may have electric centers that are non-co-located within the antenna system. Typically, the dual polarized radiators have substantially rotationally symmetric radiation patterns in the forward azimuth plane in response to a fixed linearly polarized signal having orientation within 45° of a co-polarized orientation and two polarized radiators that are orthogonal to each other, such as a typical "T" shaped dipole antenna element, with two planar radiating elements positioned orthogonal to each other and oriented at +45° and −45°, respectively, to the main antenna axis.

The antenna may be a single column array, single-band antenna or a multi-column, multi-band antenna. Specific embodiment described below for a single column array, single-band antenna (see FIGS. 22, 23), a two column array, dual-band antenna (see FIGS. 24-26), and a three column array, triple-band antenna (see FIG. 27). Aside from the beam shaping structures, the remaining components of the antennas may be made in any suitable manner presently known for conventional antennas or developed in the future in the normal course of the development of antenna materials and design. The antennas shown in the figures are generally shown substantially to scale, and the size of the dipole antenna elements and the distances between the dipoles depend on the operational frequency band of the array, as will be understood by those skilled in the art of base station antenna design.

Figure 2:
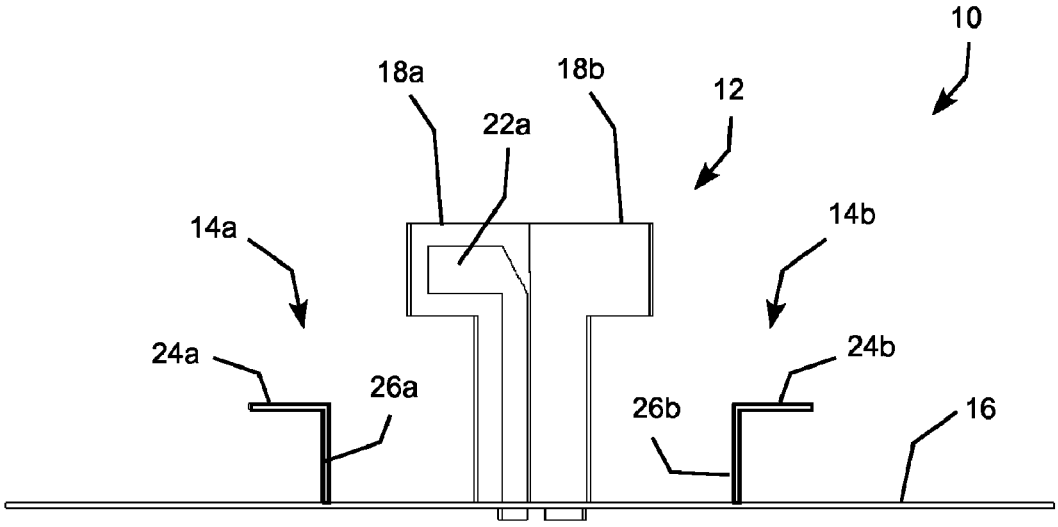
FIG. 2 is an end view of the portion of the base station antenna shown in FIG. 1.
Figure 3:
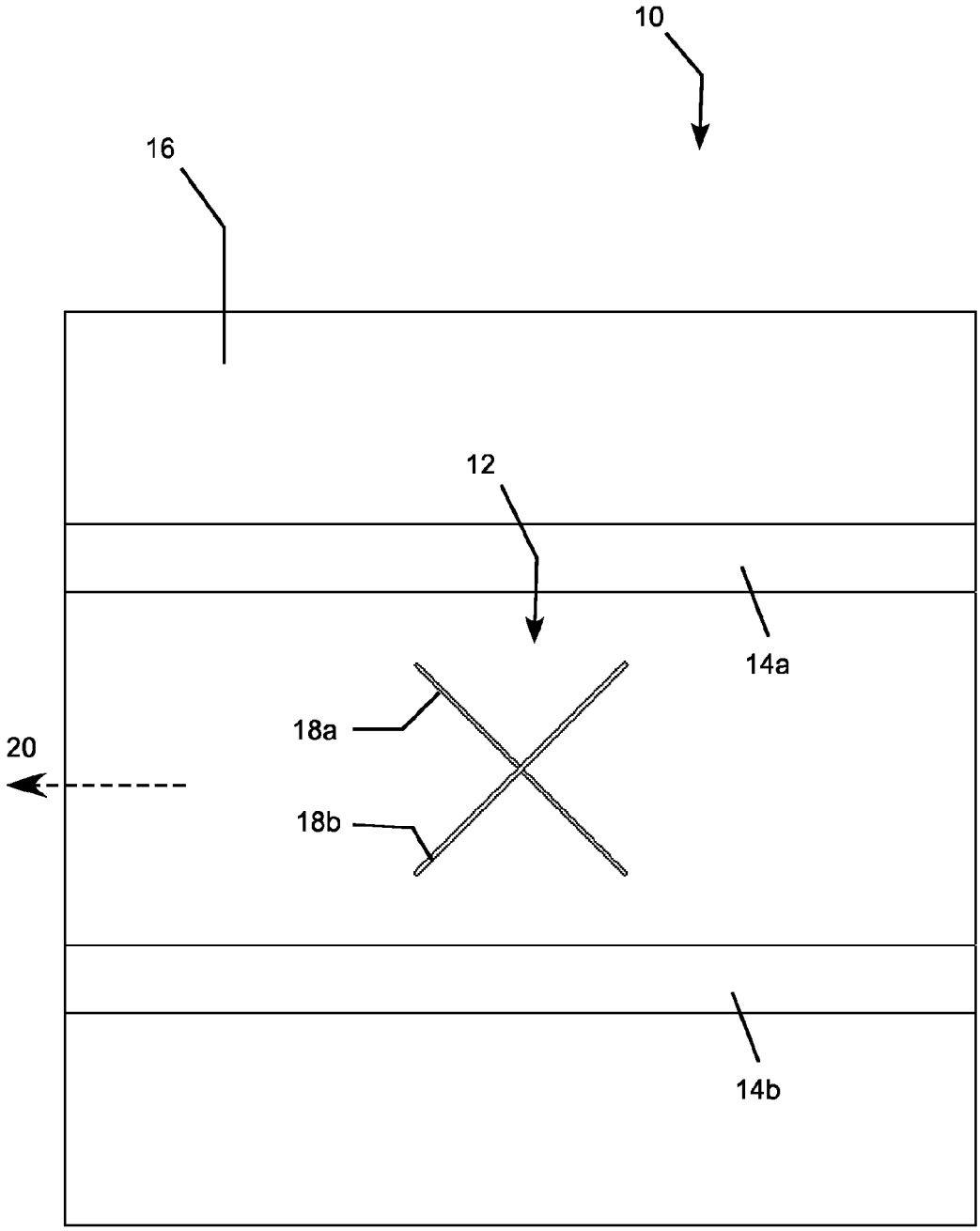
FIG. 3 is a top view of the portion of the base station antenna shown in FIG. 1.

Turning now to the figures, in which like numerals refer to similar elements throughout the several figures, FIG. 1 is perspective view, FIG. 2 is an end view, and FIG. 3 is a top view of a portion of a base station antenna 10 showing one dipole antenna element 12 of an array of antenna elements extending in the direction of the main antenna axis 20. The antenna also includes two beam shaping structures 14*a* and 14*b* connected to a ground plane 16. The other elements of the antenna, which may be conventional, are not shown to avoid cluttering the figure. The dipole antenna element 12 includes two planar dielectric boards 18*a* and 18*b* positioned orthogonal to each other and oriented at +45° and −45° to the main antenna axis 20. Each dielectric board carries a planar radiating element; one of the radiating elements 22*a* is labeled in FIGS. 1 and 2. The complete array antenna 10 includes a column of similar dipole antenna elements extending in the direction of the main antenna axis 20 with the beam shaping structures 14*a* and 14*b* extending the length of the array with one beam shaping structure one each side of the array. The beam shaping structures control the shape of the beam emitted by the antenna element in the azimuth plane.

It will be appreciated that the antenna 10 is a duplex antenna both emitting and receiving signals in a bi-directional communication system, such as a wireless telephone system. Nevertheless, only the transmission function of the antenna is sometimes described as a matter of descriptive convenience. In additional, only one of the beam shaping structures 14*a* is sometimes described as a matter of descriptive convenience, it being understood that there are two substantially identical beam shaping structures located on either side of the antenna array. In general, many other standard base station antenna, such as elements of the antenna enclosure, radome, antenna feed system, phase shifters, cabling, cable connectors, mounting brackets, tilt motors, filters, and so forth have been omitted to avoid cluttering the figures. It should also be understood that the dual polarization antenna emits a first communication signal embedded in the first polarization component and a second communication signal embedded in the second polarization component, as is known for wireless base station antennas and their associated communication systems.

The beam shaping structure 14*a* has an inverted-L shape, with a first wall 24*a* extending upward perpendicular from the ground plane 16 and a second wall 26*a* extending parallel to the ground plane from the first wall and spaced apart from the ground plane by a predetermined distance. As explained in greater detail with reference to FIGS. 13 and 14, the specific shape of the beam shaping structure controls the shape of the beam emitted by the antenna elements. In this particular antenna, the beam shaping structure 14*a* is physically and electrically connected to the ground plane, and therefore electrically grounded.

Figure 4:
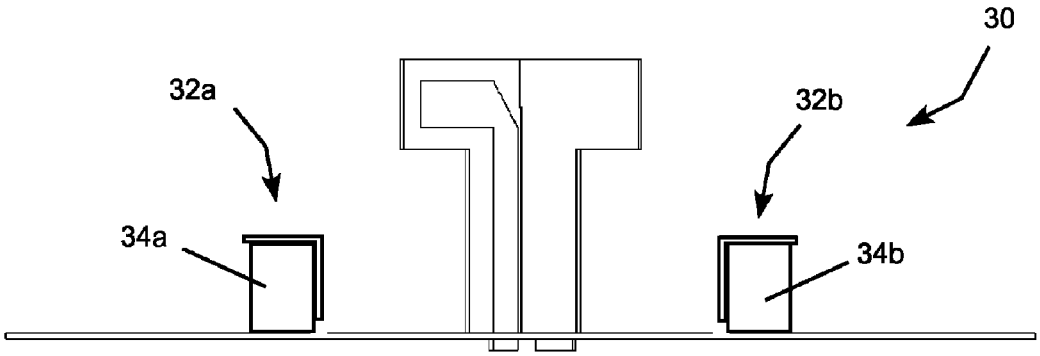
FIG. 4 is an end view of a base station antenna having a first beam shaping structure arrangement.
Figure 5:
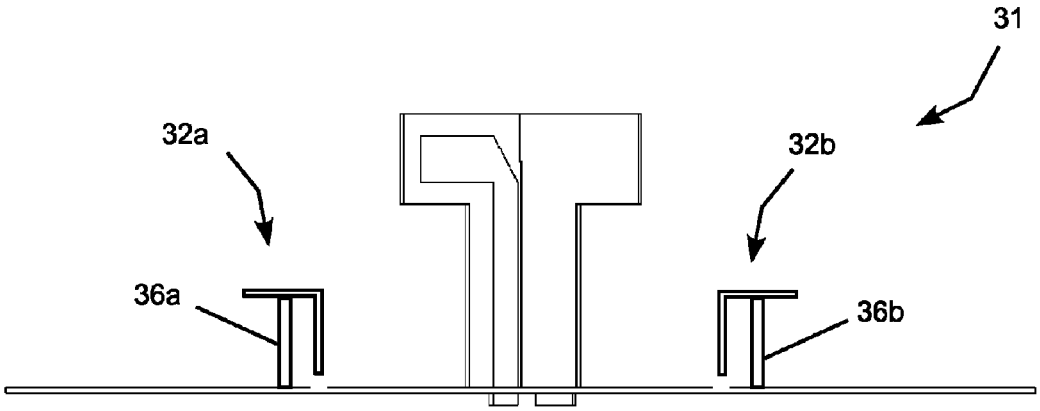
FIG. 5 is an end view of a base station antenna having a second beam shaping structure arrangement.
Figure 6:
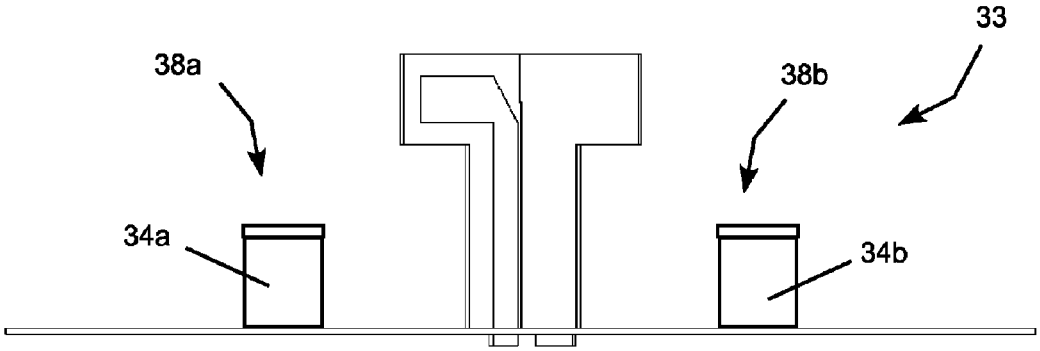
FIG. 6 is an end view of a base station antenna having a third beam shaping structure arrangement.

Although the grounded "L" shaped flange sections 14*a* and 14*b* have been found to function well as beam shaping structures, the beam shaping structures may be floating from ground or capacitively coupled to the ground plane, if desired. They may also have other shapes, such as a single wall perpendicular to the ground plane, a single wall parallel to the ground plane, a curved surface, or any other shape that imparts a desired beam shape. As illustrative examples, FIG. 4 shows a base station antenna 30 having a first alternative pair of beam shaping structures 32*a* and 32*b*, which are inverted-L shaped sections similar to the surfaces 14*a* and 14*b* except that the structures are not electrically grounded, but instead are suspended apart from the ground plane 16 by spacers 34*a* and 34*b*, respectively. The spacers may be continuous or segmented blocks of an insulator, such as a suitable plastic, or a dielectric material. The beam shaping structures 32*a* and 32*b* are not directly connected to the ground plane 16 and, therefore, are parasitically coupled to the antenna elements. FIG. 5 is an end view of another base station antenna 31 in which the beam shaping structures 32*a* and 32*b* are supported by a pair of continuous walls or a series of posts represented by the posts 36*a* and 36*b*. FIG. 6 is an end view of another illustrative base station antenna 33 in which the beam shaping structures are flat plates 38*a* and 38*b* rather than "L" shaped flange sections supported by the continuous or segmented blocks 34*a* and 34*b*, respectively. Many other beam shaping structures, both grounded and ungrounded, may be employed.

Figure 7:
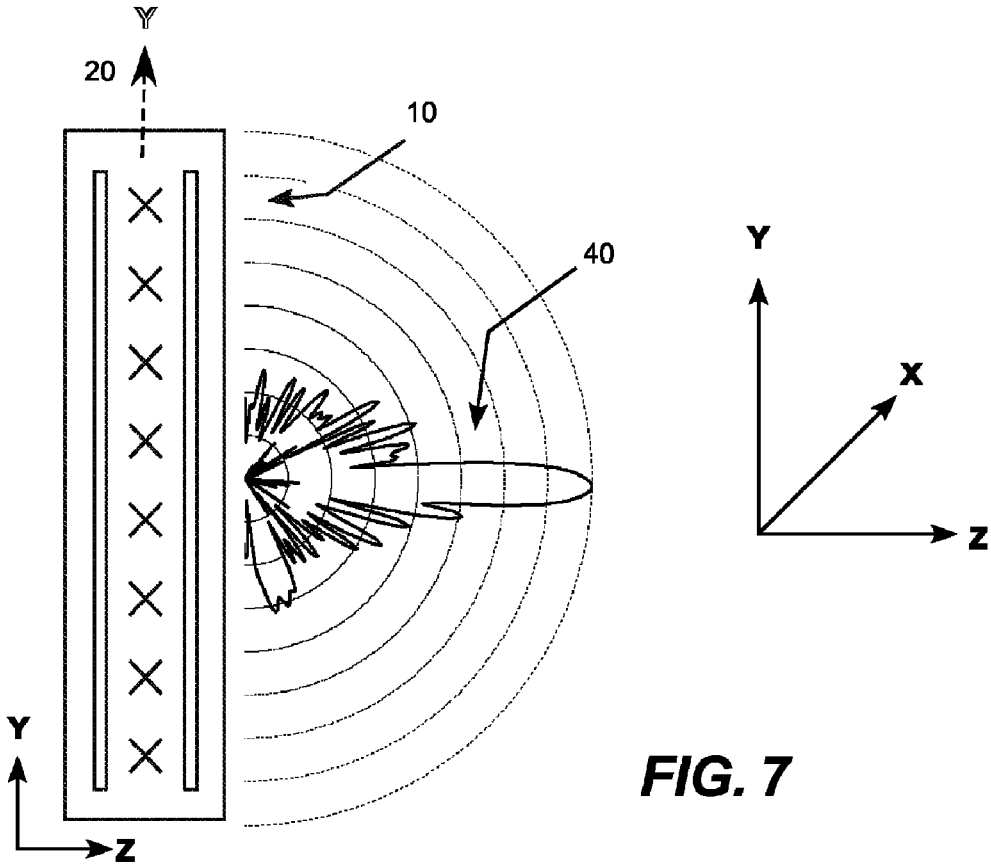
FIG. 7 is a conceptual illustration of a dual polarization antenna with an extremely condensed elevation view of its beam pattern.

FIG. 7 is a conceptual illustration of a dual polarization antenna 10 showing an extremely condensed elevation depiction of its beam 40 in the context of a Cartesian coordinate system. As shown in FIG. 7, the antenna 10 is typically installed with the main axis of the antenna 20 oriented vertically, which is the "Y" direction in the illustrated coordinate system. The ground plane 16 lies in the "Y-Z" plane, with the antenna 10 having an elongated dimension in the "Y" direction and a narrower dimension in the "Z" direction. The elongated array of antenna elements, which extends in the "Y" direction, is effective in pointing and focusing the beam 40 in the "Y-Z" elevation plane toward the positive portion of the "Z" axis extending in front of the antenna. While the array extending in the "Y" direction controls the elevation beam profile in the "Y-Z" plane, the beam shaping structures are effective in controlling the azimuth beamwidth beam profile in the "X-Z" plane. The beam shaping structures are also effective in improving the front-to-back ratio of the antenna, which is the amount of energy emitted in the positive "Z" direction compared to the negative "Z" direction.

Figure 8:
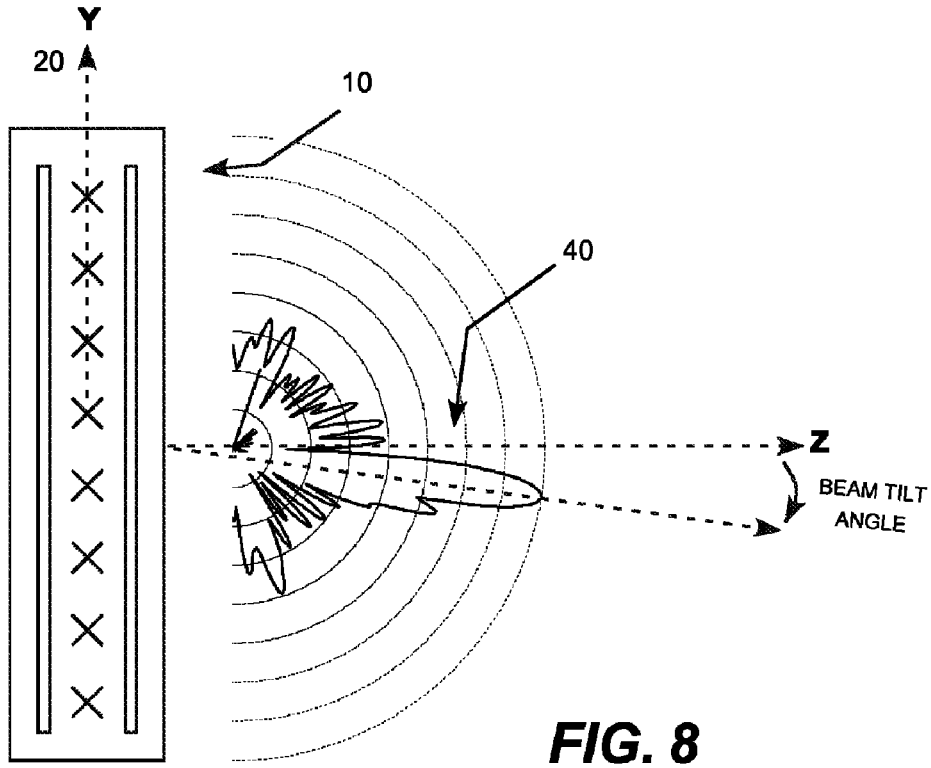
FIG. 8 is a conceptual illustration of a dual polarization antenna with an extremely condensed elevation view of its beam pattern illustrating beam tilt.

The following discussion will describe the effect of the beam shaping structures on E(theta) and E(phi), which are the vertical and horizontal polarization components, respectively, on an azimuth slice through the center of the beam 40, which lies horizontal in the "X-Z" plane as shown in FIG. 7. However, it should be understood that the antenna 10 itself may be physically pointed in any direction and the beam 40 may be electrically tilted with respect to the major axis 20 of the antenna. In practice, the beam 40 is typically tilted as shown in FIG. 8 to point the beam slightly downward from an elevated tower or building location toward the ground area to be covered by the beam. Therefore, E(theta) and E(phi) should be understood to lie in the pointing direction of the antenna beam, which is the direction of maximum energy emission, whatever that pointing direction may be. Nevertheless, the beam is described as lying in a horizontal plane and the wide angle of the beam is described as an azimuth angle for descriptive convenience.

Figure 9:
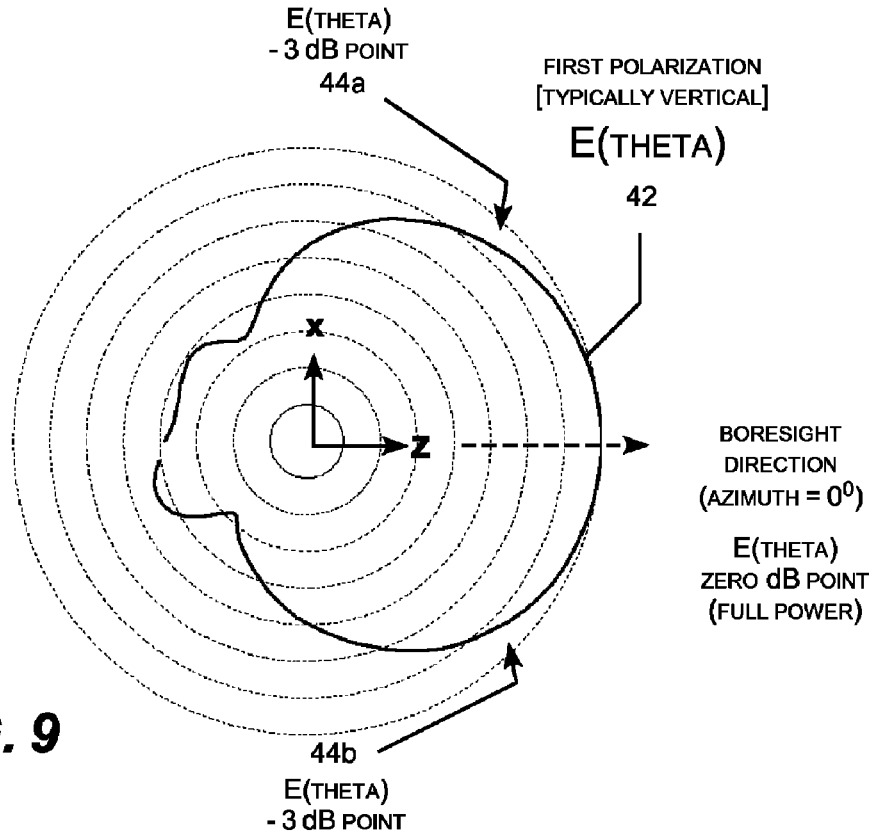
FIG. 9 is a graph showing the vertical polarization E(theta) azimuth beam pattern of an idealized dual polarization antenna.

FIG. 9 is a conceptual illustration showing the E(theta) azimuth beam pattern 42 for an idealized dual polarization antenna with desirable beam pattern characteristics. E(theta) is the vertical polarization component of the beam 40 lying in a "horizontal slice" through the "X-Z" plane, which is shown extending left to right in accordance with the coordinate system defined with reference to FIG. 7. The antenna is positioned in the center of the concentric circles, which each represent a 5 dB transmission loss from the beam pointing direction, which is normalized to 0 dB. The forward pointing portion of E(theta) has a rotationally symmetric profile about the positive portion of the "Z" axis and a wide beamwidth, which is typically defined as the azimuth angle between the 3 dB drop points 44*a* and 44*b* (the azimuth range extending between the 3 dB drop points is sometimes referred to as the "3 dB beamwidth"). E(theta) is heavily pointed in the positive "Z" portion of the "X-Z" plane, in accordance with its high front-to-back ratio.

Figure 10:
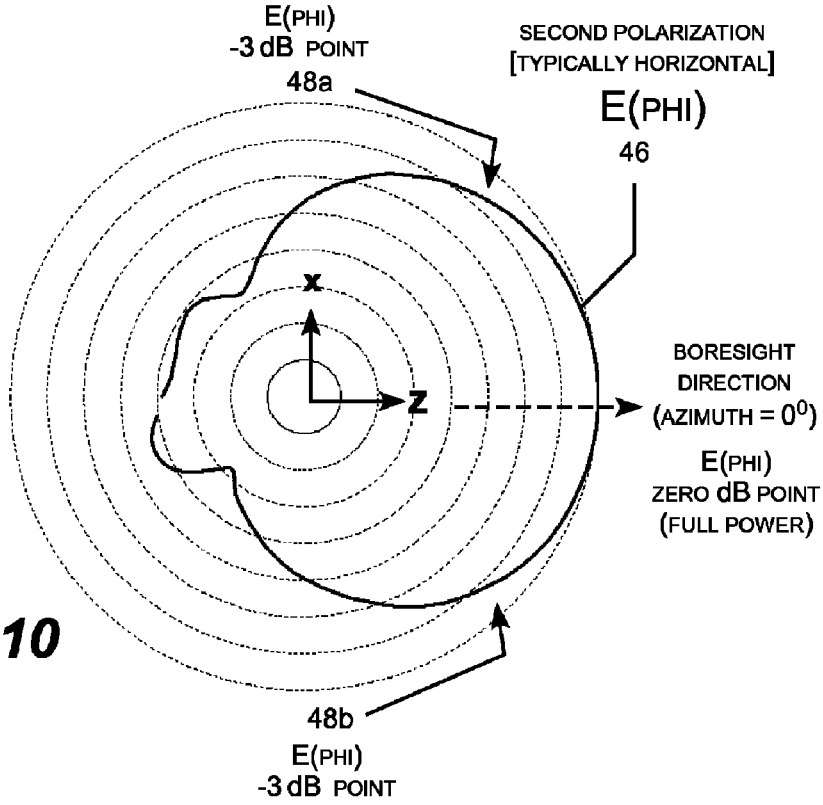
FIG. 10 is a graph showing the horizontal polarization E(phi) azimuth beam pattern of an idealized dual polarization antenna.

FIG. 10 is a conceptual illustration showing the horizontal polarization component E(phi) azimuth beam pattern 46 for the idealized dual polarization antenna. In the ideal situation, E(phi) perfectly matches E(theta) with the E(phi) 3 dB drop points 48*a* and 48*b* perfectly overlying the E(theta) 3 dB drop points 44*a* and 44*b*. This would represent perfect polarization for the beam. Due to the nature of the dipole antenna elements employed an imperfections in the antenna and the transmission media, E(theta) and E(phi) are not perfectly matched in a real propagating beam. The objective of the beam shaping structures of the present invention is to widen the beam, improve the front-to-back ratio of the beam, and improve the polarization by making E(theta) and E(phi) match each other more closely, particularly in the pointing direction of beam between the 3 dB drop points.

Figure 11:
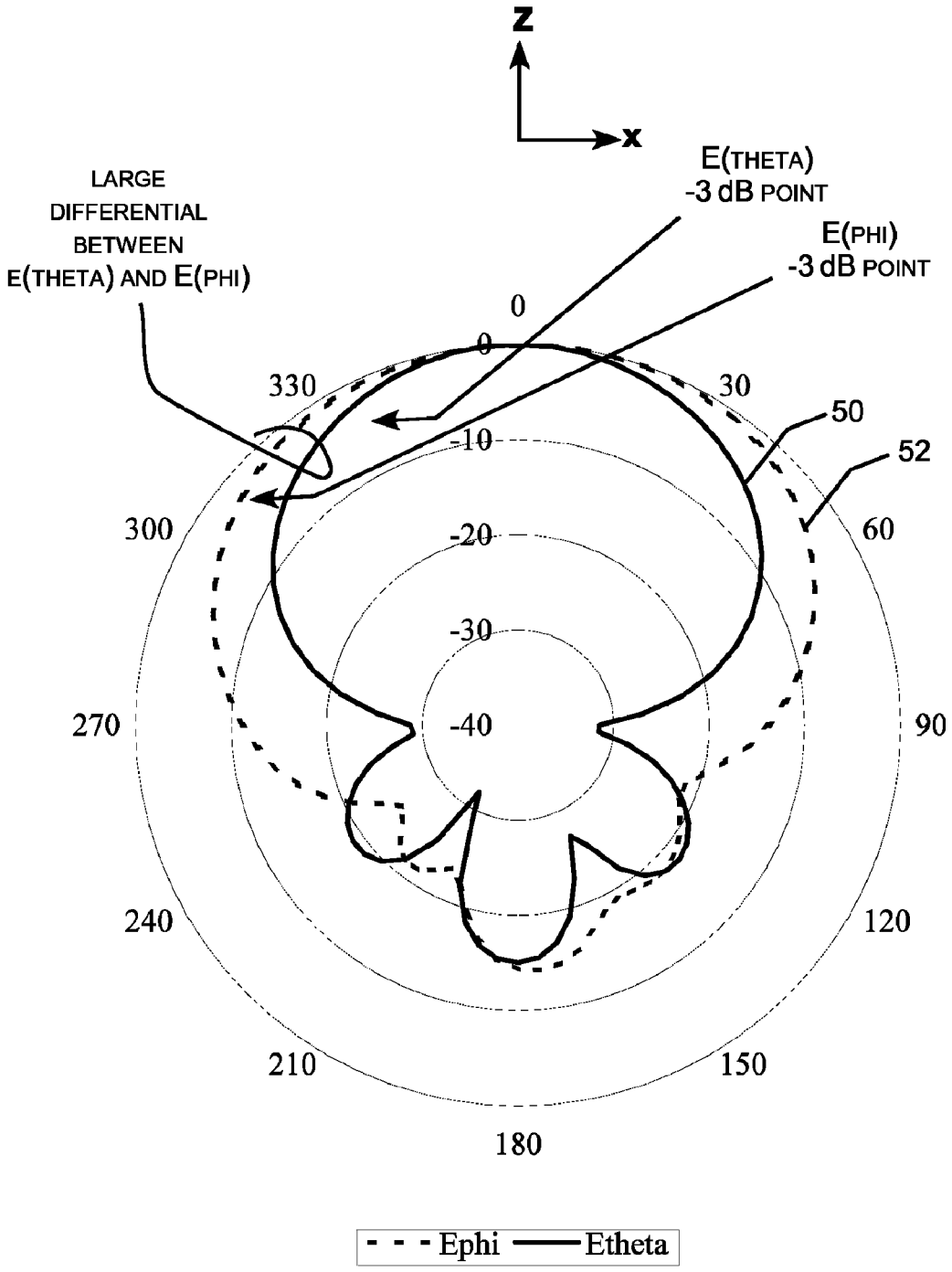
FIG. 11 (PRIOR ART)
FIG. 11 is a graph showing the E(theta) and E(phi) azimuth beam patterns of a typical prior art dual polarization antenna without beam shaping structures exhibiting undesirable beam pattern characteristics.

FIG. 11 is a graph showing the E(theta) and E(phi) azimuth beam patterns 50, 52 for a prior art dual polarization antenna without beam shaping structures exhibiting undesirable beam pattern characteristics. For FIG. 11, the pointing direction (i.e., the "Z" direction shown in FIGS. 7-10) is shown upward with the 0 dB point in the 12 o'clock position, in accordance with the usual convention. FIG. 11 shows E(theta) and E(phi) beam patterns that vary widely within a 120° azimuth beamwidth, with a large beamwidth differential between the E(theta) and E(phi) 3 dB points. The E(theta) and E(phi) 3 dB points are not within 5° of each other, and E(theta) and E(phi) are only maintained within 3 dB of each other up for a relatively narrow beamwidth.

Figure 12:
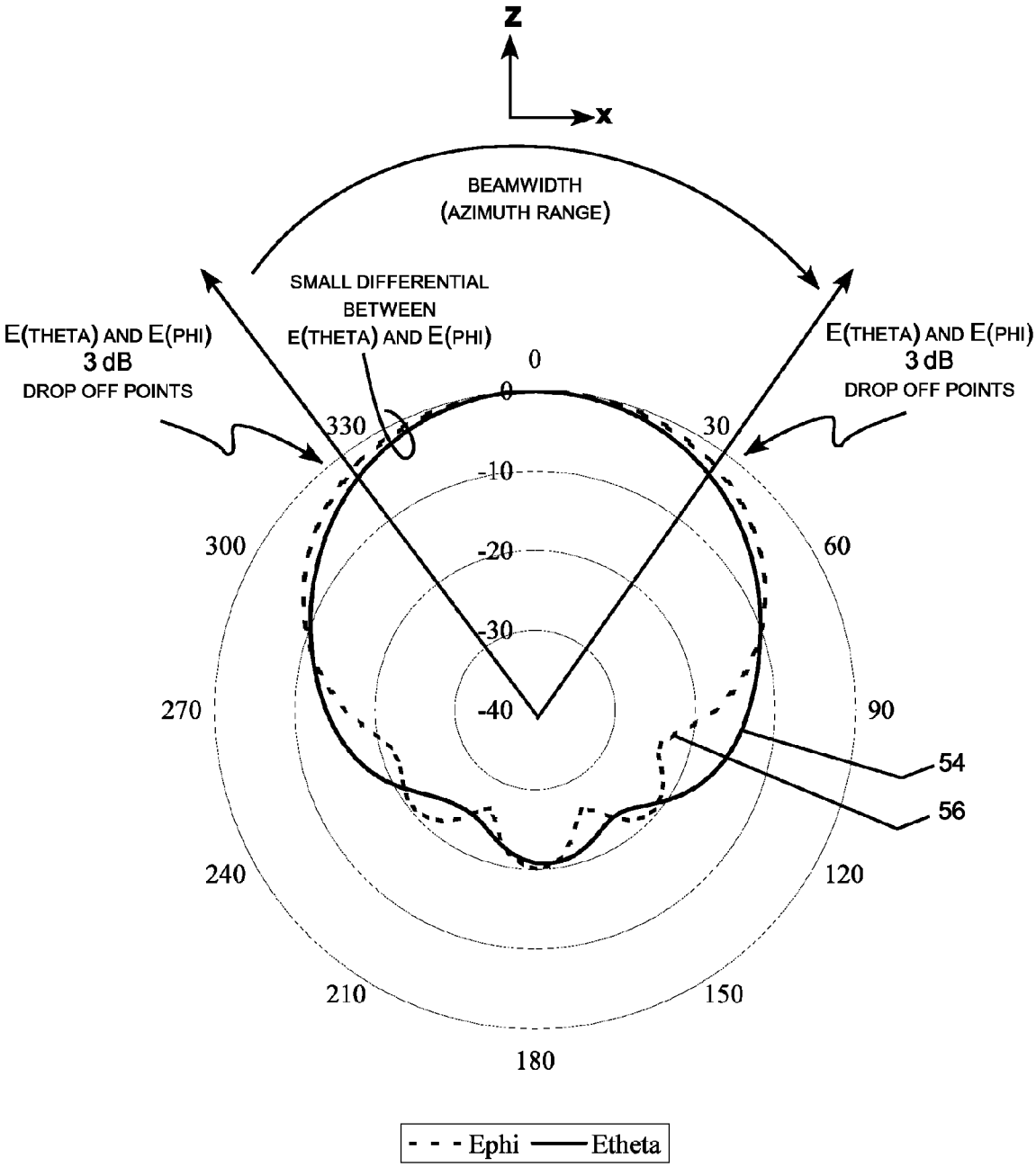
FIG. 12 is a graph showing the E(theta) and E(phi) azimuth beam patterns of a dual polarization antenna with beam shaping structures exhibiting desirable beam pattern characteristics.

FIG. 12 is a graph showing the E(theta) and E(phi) azimuth beam patterns 54, 56 for a dual polarization antenna with beam shaping structures exhibiting desirable beam pattern characteristics. In particular, the E(theta) and E(phi) 3 dB points are within 5° of each other, and E(theta) and E(phi) remain within 3 dB of each other across a relatively wide beamwidth. It should be understood that the E(theta) and E(phi) beam patterns 54, 56 are shown for the center frequency for which the antenna is defined. A similar graph could be drawn for each of multiple frequencies within a range about the center frequency. Preferably, the beam shaping structures drive E(theta) and E(phi) to meet the performance characteristics described above for a wide bandwidth, typically equal to at least about 30% of the center frequency. That is, the E(theta) and E(phi) 3 dB points are within 5° of each other, and E(theta) and E(phi) remain within 3 dB of each other across a desired beamwidth up to about 120° and over a bandwidth up to about 30% of the center frequency.

Figures 13, 14:
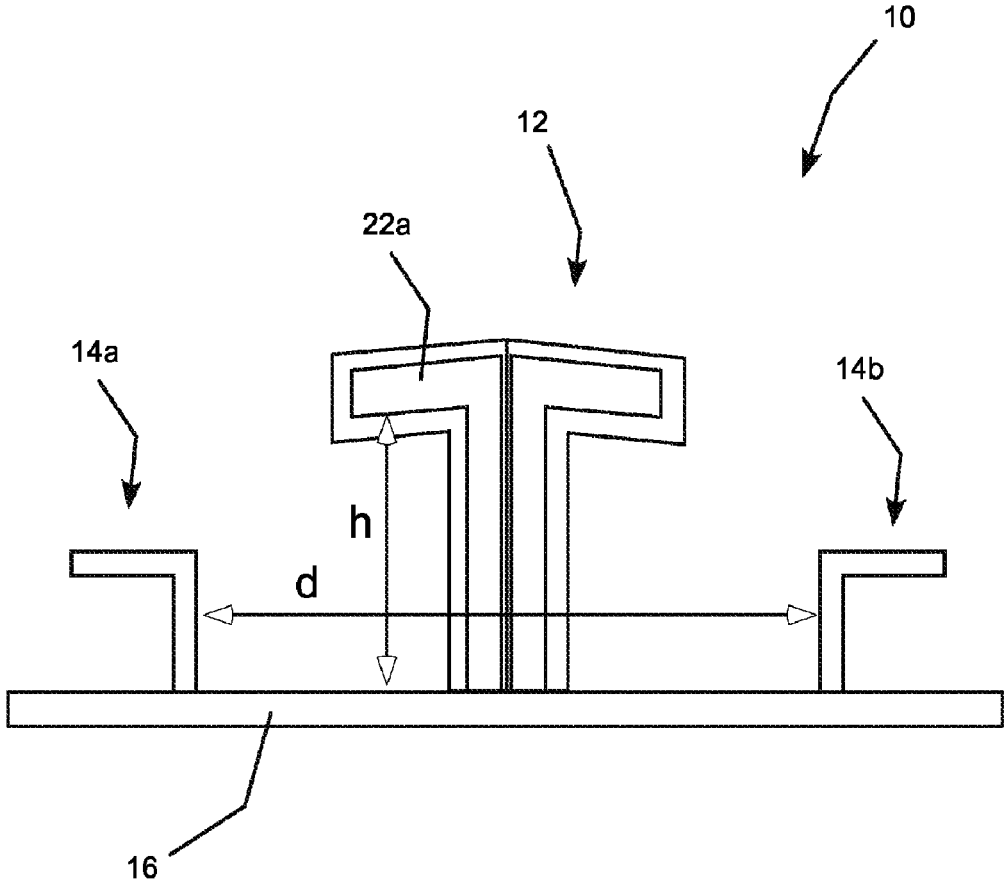
FIG. 13 is a conceptual illustration showing design parameters for constructing a dual polarization antenna with beam shaping structures.
FIG. 14 is a table listing specific examples for the design parameters illustrated in FIG. 13 for constructing dual polarization antennas exhibiting desirable beam pattern characteristics for beamwidths of 45°, 65°, 85°, 90°, and 120°.

FIG. 13 is a conceptual illustration showing design parameters "d" and "h" for constructing a dual polarization antenna with beam shaping structures exhibiting the desired beam pattern characteristics described above. The parameter "d" represents the internal distance between the beam shaping structures 24*a* and 24*b*, and the parameter "h" represents the distance between the ground plane 16 at the bottom of the horizontal arm of the radiating elements 18*a* and 18*b* of the dipole antenna element 12. It has been found that the E(theta) and E(phi) responses are very sensitive to the beam parameters "d" and "h" while being less sensitive to the precise height or width of the beam shaping surface. Although not critical, the beam shaping surface have been found to function as desired when they have a height above the ground plain about equal to one-half "h" and a width parallel to the ground plain about equal to one-half "h" as shown in FIG. 13.

FIG. 14 is a table listing specific examples for the design parameters "d" and "h" illustrated in FIG. 13 for constructing dual polarization antennas exhibiting the desired beam pattern characteristics for 3 dB beamwidths of 45°, 65°, 85°, 90°, and 120°. For a desired beamwidth of 45°, "d" is equal to 1.04 times the wavelength (lambda) in the propagating media (which for the ambient atmosphere is close to free space) and "h" is equal to 0.22 times the wavelength. For a desired beamwidth of 65°, "d" is equal to 0.74 times the wavelength and "h" is equal to 0.22 times the wavelength. For a desired beamwidth of 85°, "d" is equal to 0.57 times the wavelength and "h" is equal to 0.26 times the wavelength. For a desired beamwidth of 90°, "d" is equal to 0.52 times the wavelength and "h" is equal to 0.30 times the wavelength. And for a desired beamwidth of 120°, "d" is equal to 0.52 times the wavelength and "h" is equal to 0.39 times the wavelength. Of course, the desired parameters for all other desired beamwidths up to 120° and somewhat beyond 120° can be extrapolated or determined experimentally.

Figure 15:
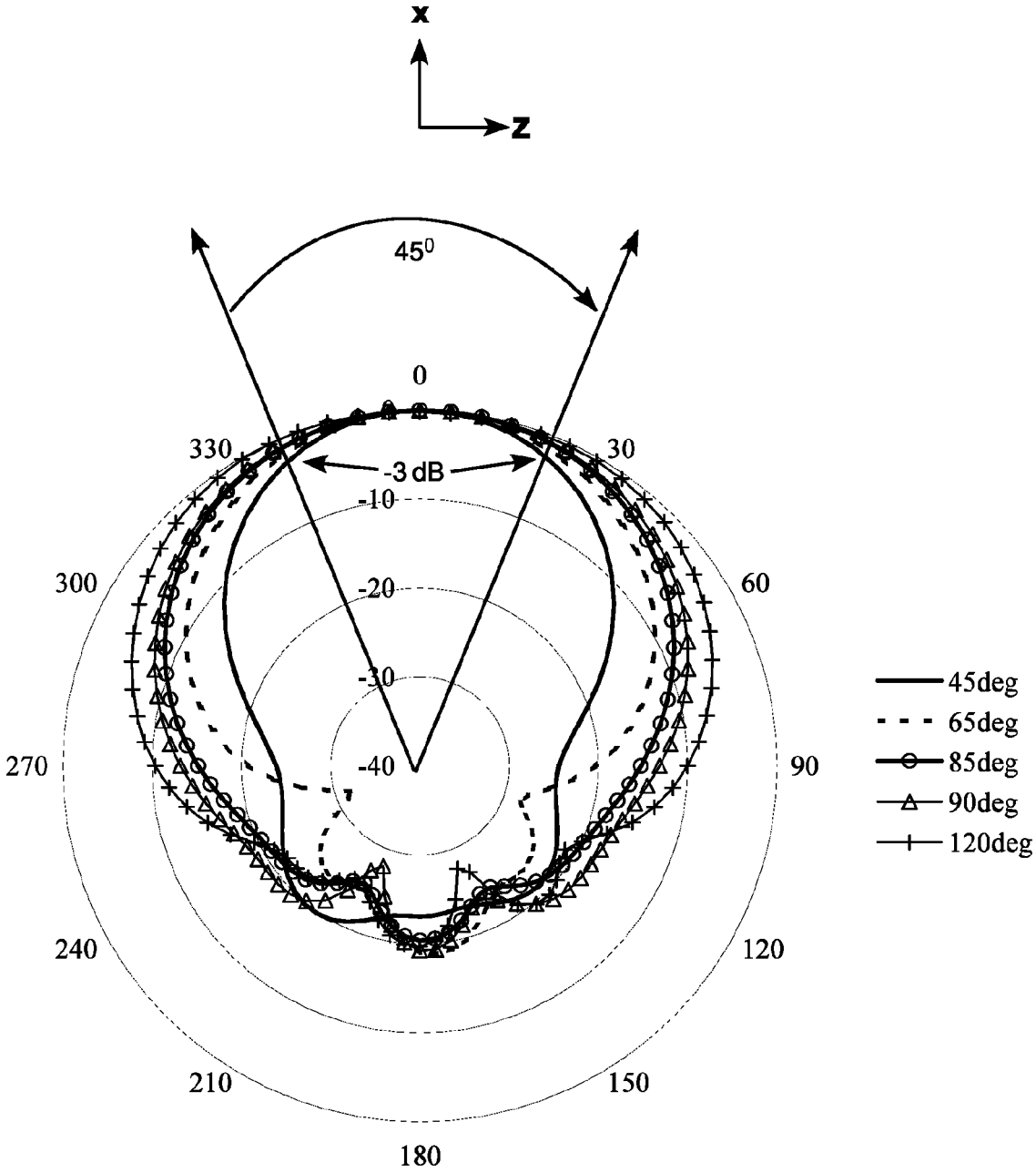
FIG. 15 is a graph illustrating azimuth beam patterns for the antennas defined by the specific example design parameters listed in the table of FIG. 14.

FIG. 15 is a graph illustrating the total energy azimuth beam patterns for the antennas defined by the specific example design parameters listed in the table of FIG. 14. The 3 db points and the beamwidth is shown for the 45° beam for illustrative purposes. The other graphs are not labeled to avoid cluttering the diagram.

Figure 16:
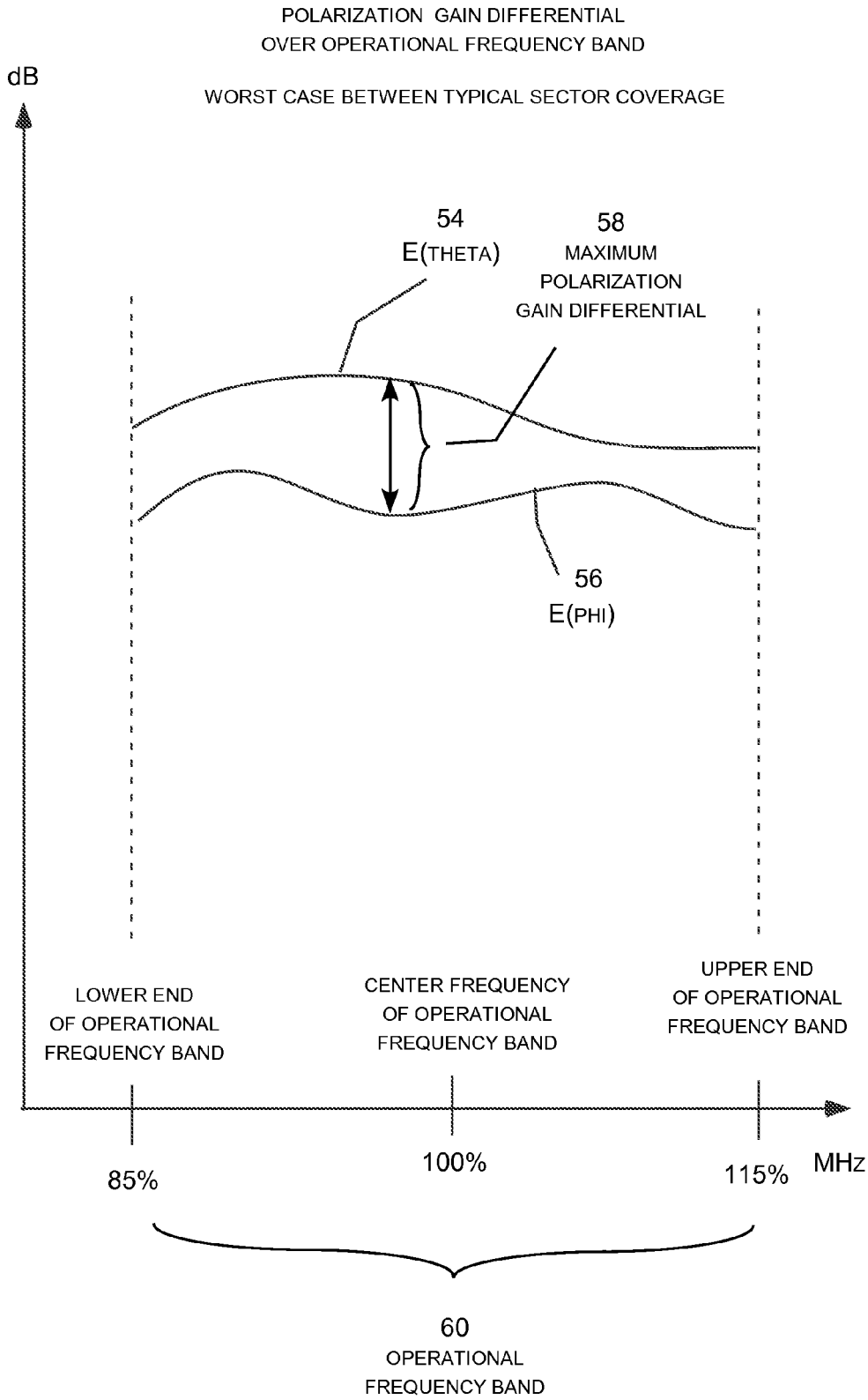
FIG. 16 is a graph illustrating the desired constraint on the E(theta) and E(phi) performance over the desired bandwidth.
Figure 17:
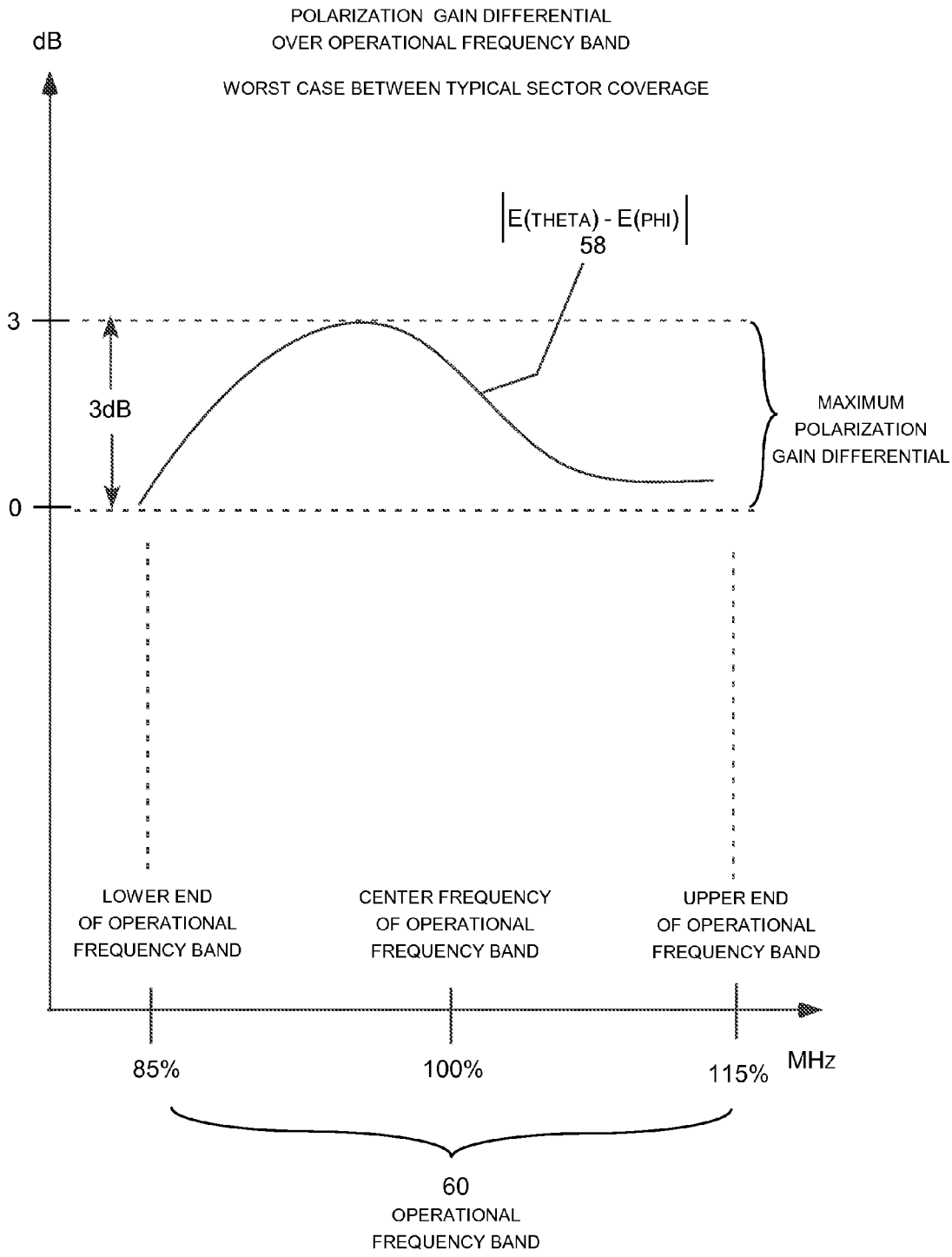
FIG. 17 is a graph illustrating the desired constraint on the polarization gain differential between E(theta) and E(phi) over the desired bandwidth.

FIG. 16 is a graph illustrating the desired constraint on the E(theta) 54 and E(phi) 56 over the desired bandwidth 60. That is, the polarization gain difference 58 between E(theta) and E(phi) across the 3 dB bandwidth is not greater than 3 dB over a bandwidth 60 equal to 30% of the center frequency. FIG. 17 is a graph illustrating a plot of the desired constraint on the polarization gain differential 58, which is the absolute value of the difference between E(theta) and E(phi). Again, FIG. 17 shows that the polarization gain differential 58 across the 3 dB bandwidth is not greater than 3 dB over a bandwidth 60 equal to 30% of the center frequency. It should be understood that FIGS. 16 and 17 are shown to illustrate the upper bound of the design objective in which the polarization gain differential reaches 3 dB. Some of the antennas tested (particularly those with beamwidths narrower than 120°) have achieved better performance. A maximum polarization gain differential not greater than 2 dB has been found to be achievable for many antenna configurations. It should be appreciated that FIGS. 16 and 17 are simplified in that they show E(theta), E(phi) and the polarization gain differential as each representing a single point for each frequency (i.e., line graphs), whereas these values actually vary at each frequency as the azimuth angle changes across the beamwidth. A single line depiction as shown in FIG. 17 would conceptually correspond to E(theta) and E(phi) at a single azimuth direction, whereas E(theta) and E(phi) across the full azimuth range would conceptually occupy a band or probability density at each frequency point.

Figure 18:
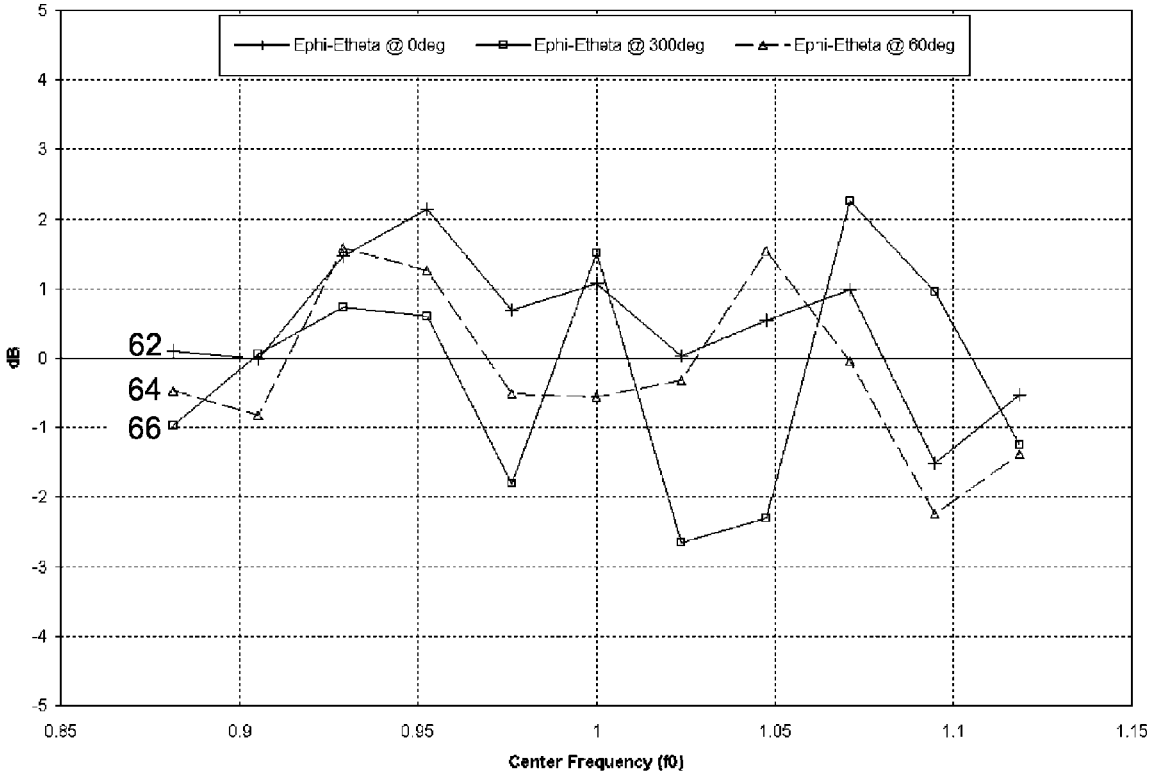
FIG. 18 is a graph showing the polarization gain differential between E(theta) and E(phi) for an example antenna at 0°, 300°, and 60° azimuth directions.
Figure 19:
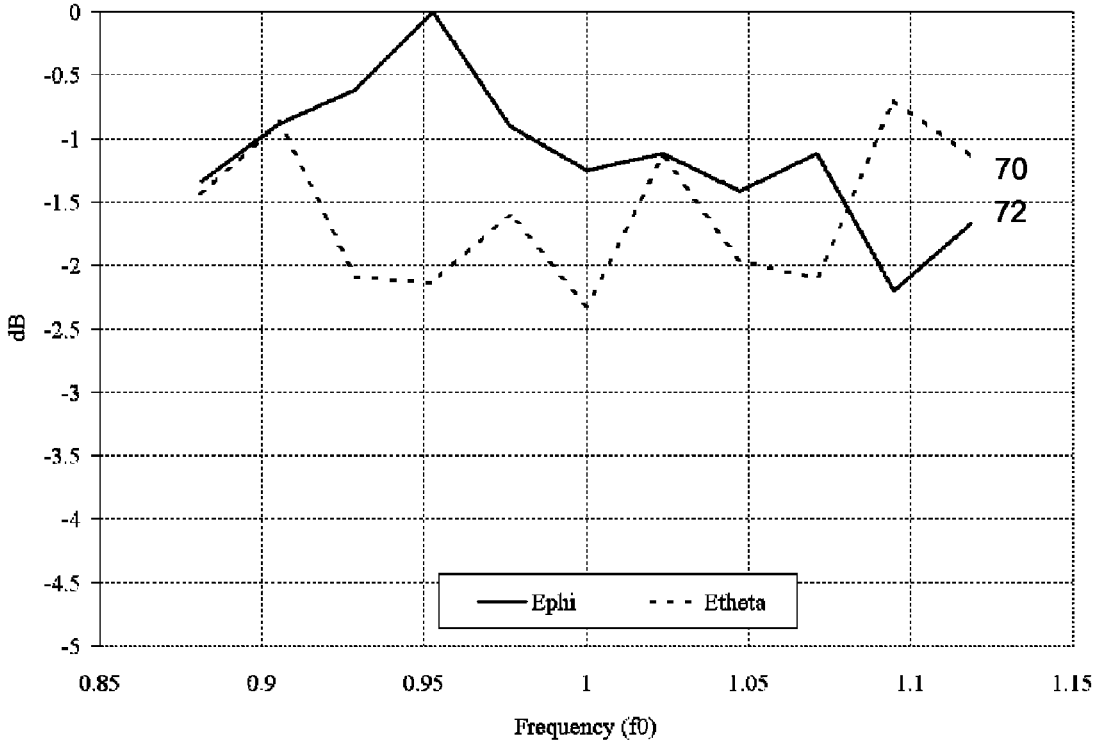
FIG. 19 is a graph showing E(theta) and E(phi) at 0° azimuth for the example antenna.
Figure 20:
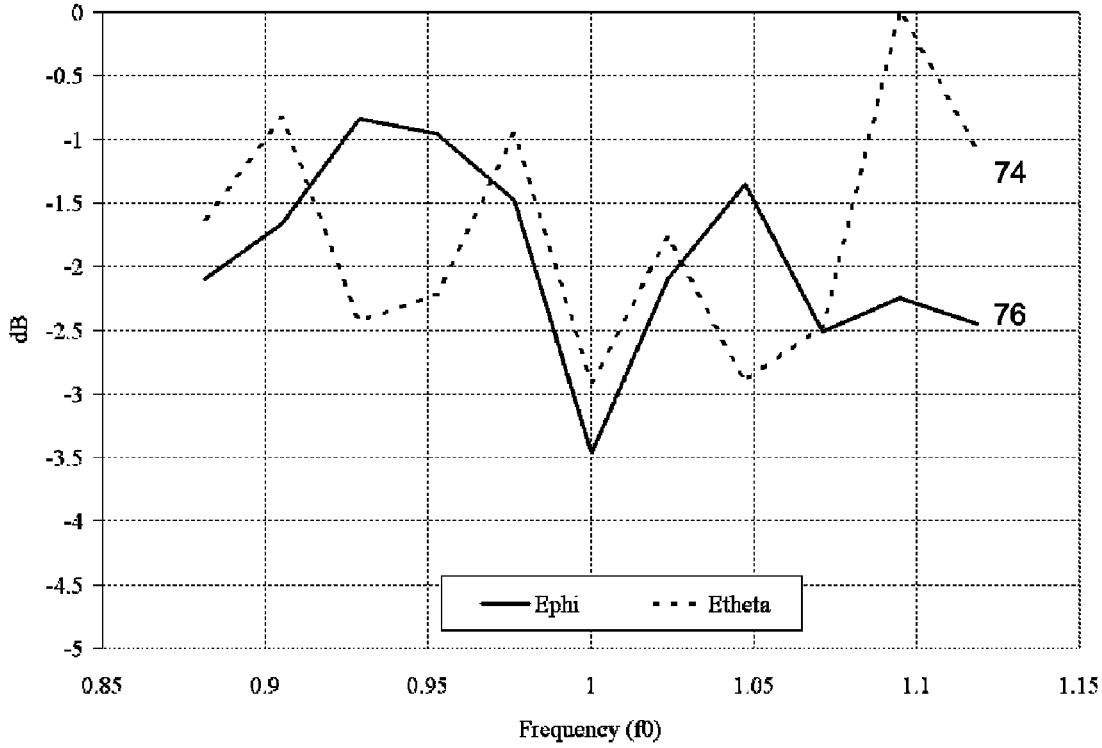
FIG. 20 is a graph showing E(theta) and E(phi) at 300° azimuth for the example antenna.
Figure 21:
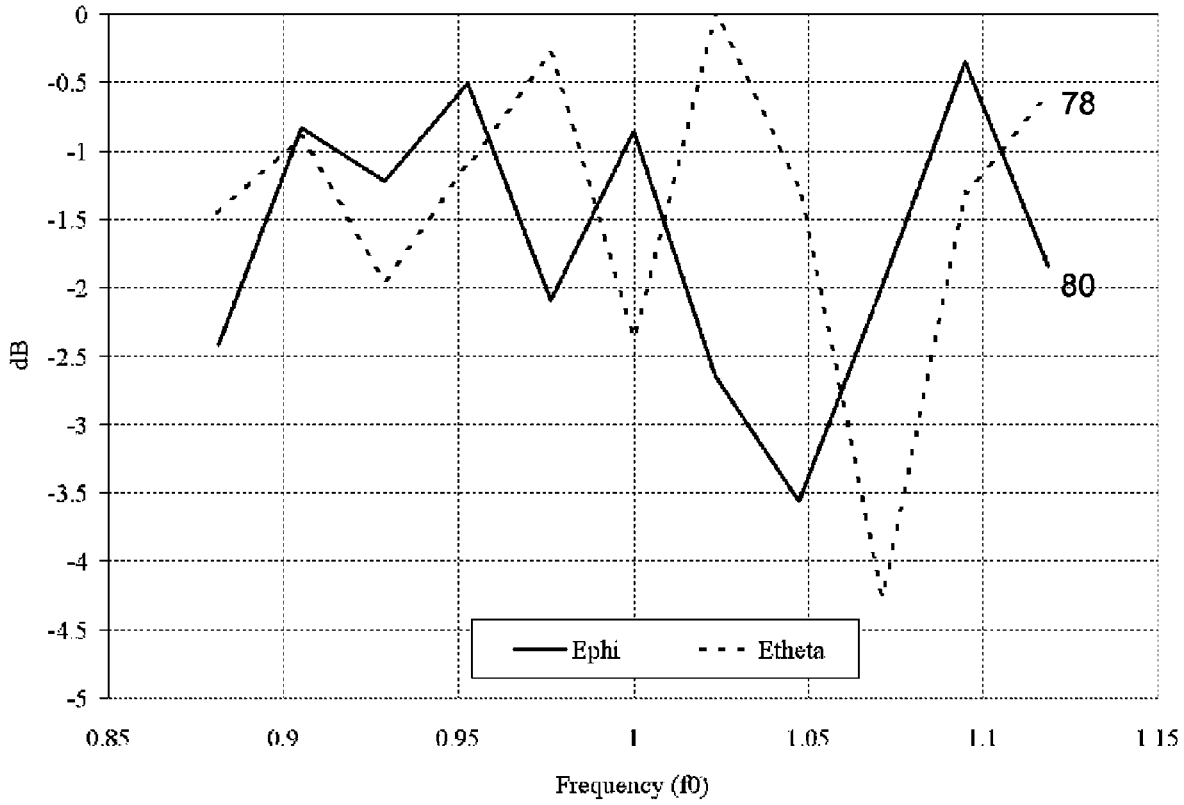
FIG. 21 is a graph showing E(theta) and E(phi) at 60° azimuth for the example antenna.

FIGS. 18-21 provide a view into the band that the polarization gain differential occupies. FIG. 18 shows the polarization gain differential between E(theta) and E(phi) for three azimuth directions, 0°, 300°, and 60°, for several points in the bandwidth from 0.85 to 1.15 times the center frequency. The graph 62 represents the polarization gain differential at 0° azimuth, the graph 64 represents the polarization gain differential at 300° azimuth (i.e., −60°), and the graph 66 represents the polarization gain differential at 60° azimuth. FIG. 19 is a graph showing E(theta) and E(phi) for the example antenna at 0° azimuth. The graph 70 represents E(theta) at 0° azimuth and the graph 72 represents E(phi) at 0° azimuth. FIG. 20 is a graph showing E(theta) and E(phi) at 300° azimuth for the example antenna. The graph 74 represents E(theta) at 300° azimuth and the graph 76 represents E(phi) at 300° azimuth. FIG. 21 is a graph showing E(theta) and E(phi) at 60° azimuth for the example antenna. The graph 78 represents E(theta) at 60° azimuth and the graph 80 represents E(phi) at 60° azimuth.

Figure 22:
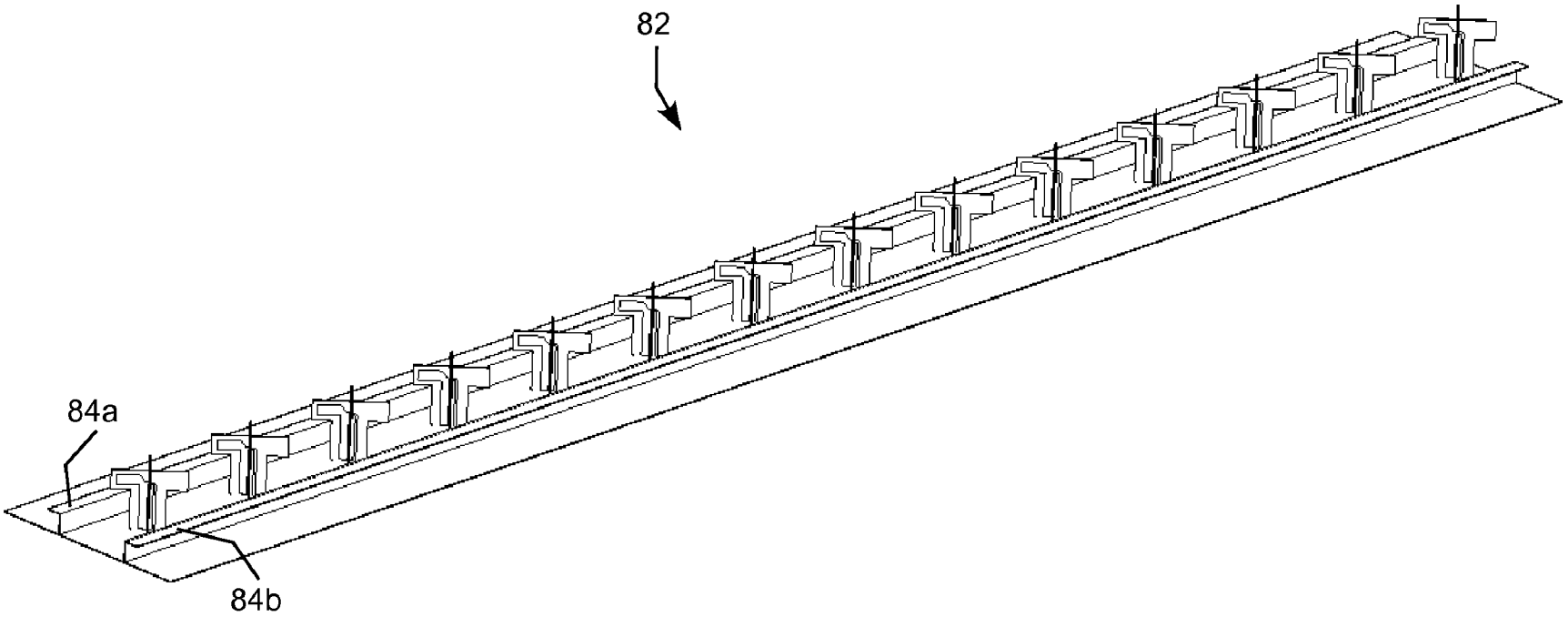
FIG. 22 is a perspective view of an example single-band dual polarization antenna with inverted-L shaped beam shaping structures.

FIG. 22 is a perspective view of an example single band dual polarization antenna 82 with inverted-L shaped beam shaping structures 84*a* and 84*b* shown substantially to scale. The illustrated antenna has fourteen dipole antenna elements, is approximately 152 cm long and 52 cm wide and configured to operate at 1940 MHz frequency. Of course, the antenna may be implemented with a different number of dipole elements, and the size of the antenna and the size and spacing of the dipole antenna elements will be different for different operational frequencies.

Figure 23:
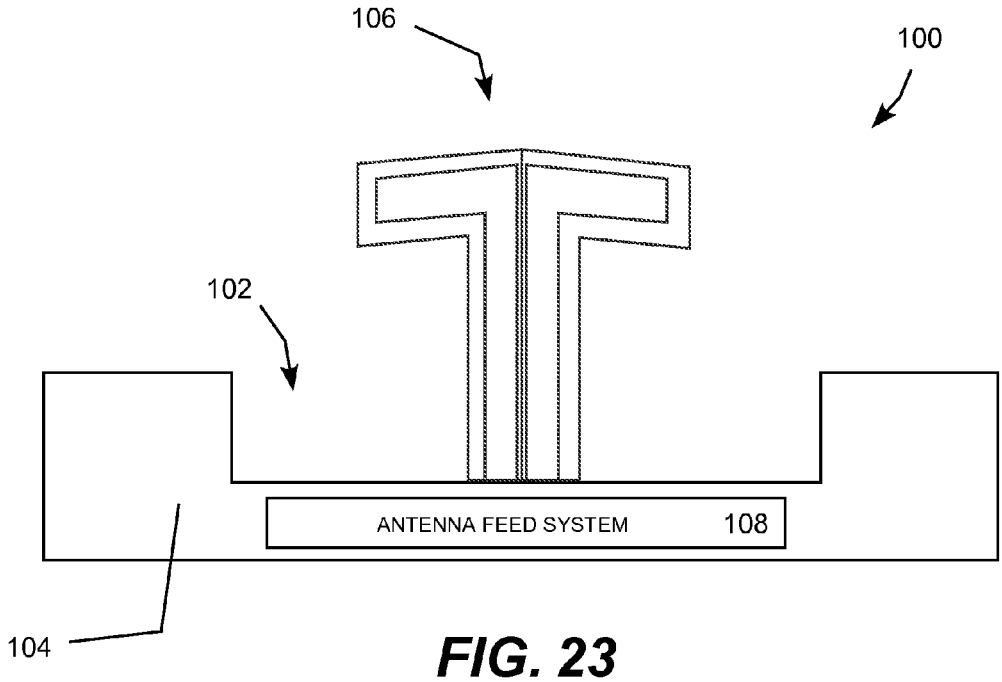
FIG. 23 is an end view of a single-band dual polarization antenna with beam shaping structures provided by a tray formed into an antenna enclosure supporting an array of dipole antenna elements.

The inventors have also developed the technique of forming the beam shaping structures as trays in the ground plane, which may form part of an antenna enclosure used to house the antenna feed system, typically including the power distribution circuits, phase shifters, and other elements of the antenna. FIG. 23 is a conceptual end view illustration of a dual polarization antenna 100 with a beam shaping tray 102 formed into an antenna enclosure 104. An array of dipole antenna elements represented by the antenna element 106 is supported by the tray, which is configured to form beam shaping structures having the "d" and "h" characteristics described previously with reference to FIGS. 13 and 14 to confer the desired beam characteristics for the antenna. The antenna enclosure 104 typically houses the antenna feed system 108, which may be carried on the rear of the shaping tray 102 or the opposing interior wall of the enclosure.

Figure 24:
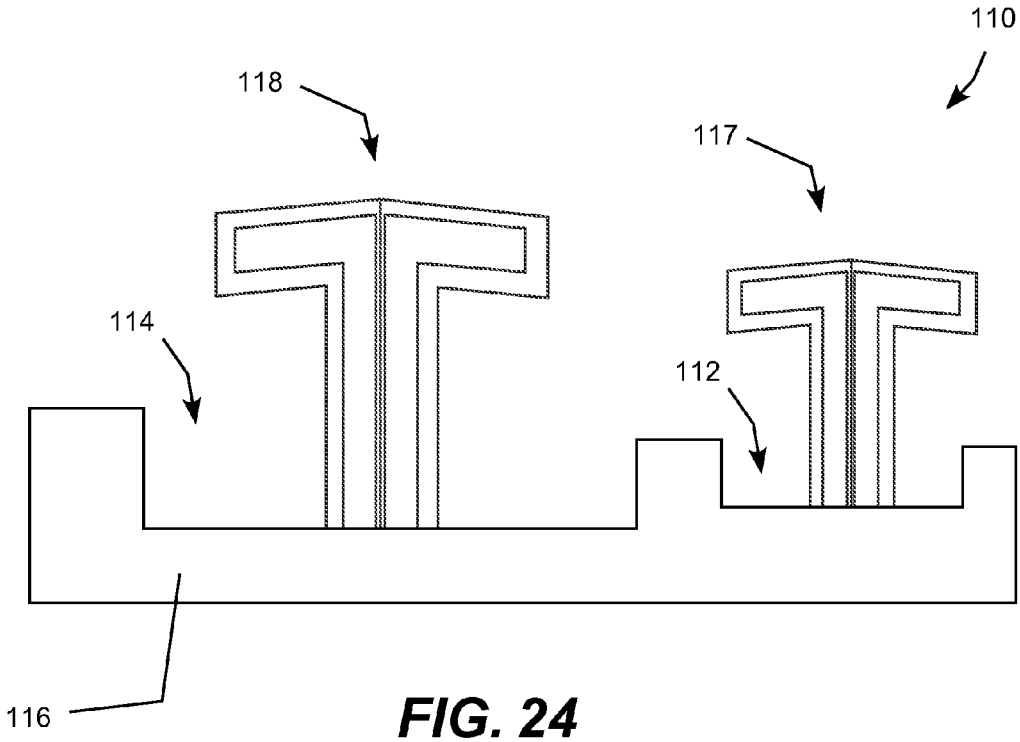
FIG. 24 is an end view of a dual-band dual polarization antenna with two sets of beam shaping structures provided by two trays formed into an antenna enclosure, each tray supporting an associated array of dipole antenna elements.

FIG. 24 is a conceptual end view illustration of a dual band antenna 110 with two beam shaping trays 112 and 114 formed into the antenna enclosure 116. The first tray 112 supports a first antenna array represented by the dipole antenna element 117 configured to operate at a first operational frequency, and the second tray 114 supports a second antenna array represented by the dipole antenna element 118 configured to operate at a second operational frequency. Again, the trays 112 and 114 are shaped to form the beam shaping structures having the "d" and "h" characteristics described previously with reference to FIGS. 13 and 14 to confer the desired beam characteristics for their respective bands.

Figure 25:
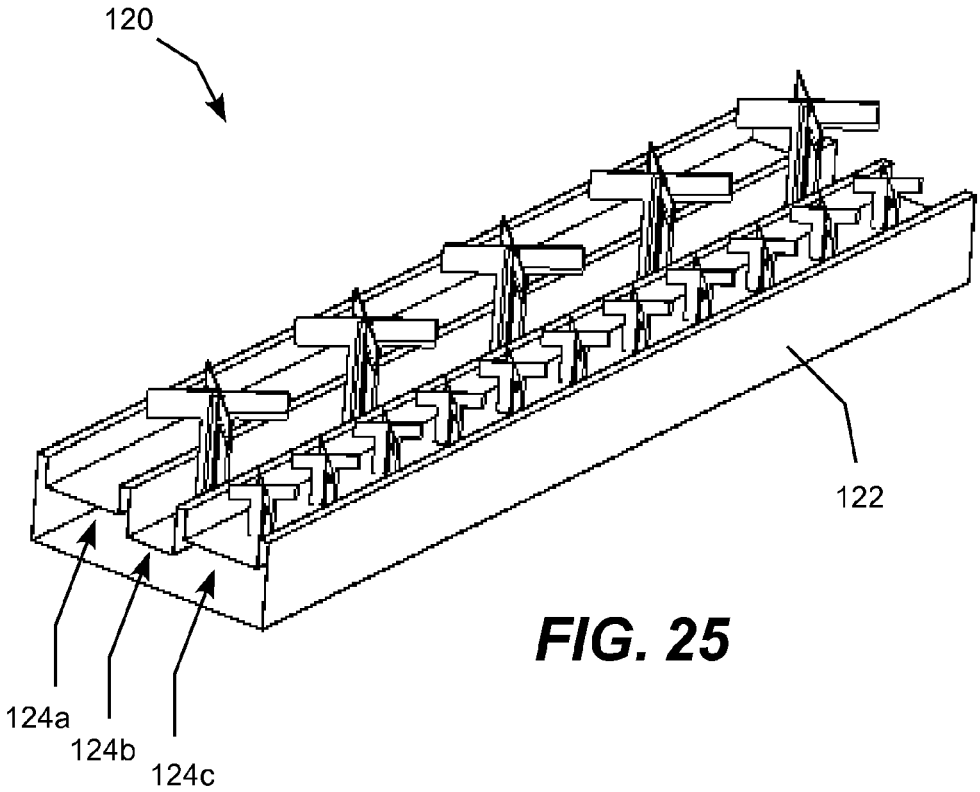
FIG. 25 is a perspective view of a dual-band dual polarization antenna with three sets of beam shaping structures provided by three trays formed into an antenna enclosure in which two of the trays carry associated antenna arrays.
Figure 26:
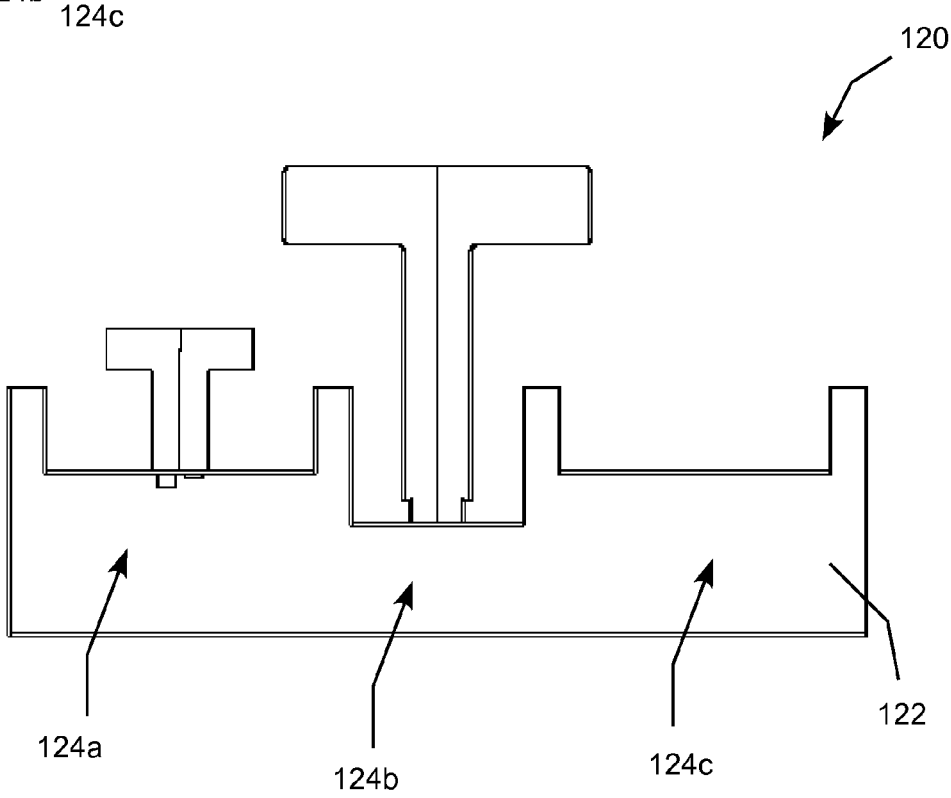
FIG. 26 is an end view of the antenna shown in FIG. 25.
Figure 27:
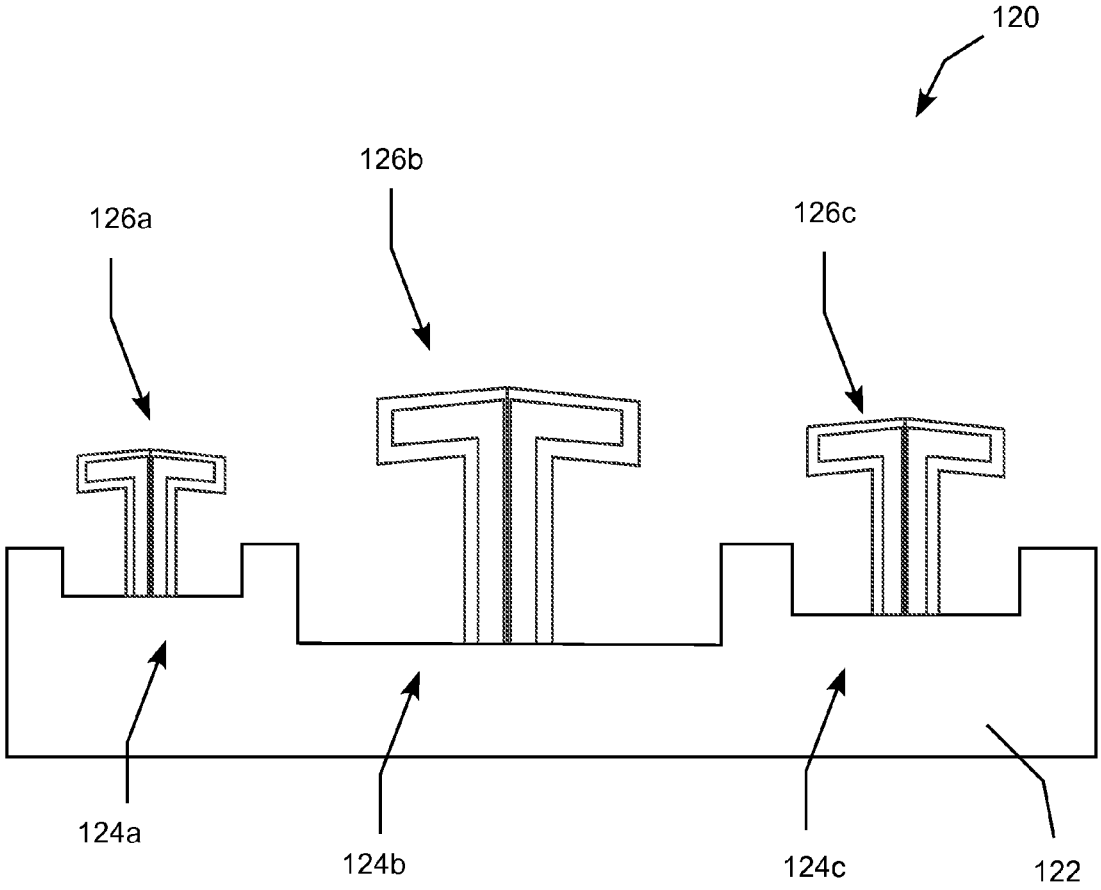
FIG. 27 is an end view of a triple-band dual polarization antenna with three sets of beam shaping structures provided by three trays formed into an antenna enclosure in which each tray carry associated antenna array.

FIG. 25 is a perspective view and FIG. 26 is an end view of a portion of an example dual-band dual polarization antenna 120 with three beam shaping structures built into an antenna enclosure 122. The enclosure defines three trays 124*a*, 124*b*, and 124*c*, which are each designed to receive an associated dipole antenna array configured to operate at a different operational frequency. This particular antenna has only two of the trays occupied with antenna arrays, resulting in a dual-band antenna. FIG. 27 shows a triple-band antenna 130 with all three trays 124*a-c* filled with corresponding antenna arrays represented by the antenna elements 126*a-c*, respectively. Many more specific embodiments of the invention will be apparent to those skilled in the art based on the specific examples shown in the figures and described above.

In view of the foregoing, it will be appreciated that present invention provides significant improvements in base station antennas for telecommunication systems. It should be understood that the foregoing relates only to the exemplary embodiments of the present invention, and that numerous changes may be made therein without departing from the spirit and scope of the invention as defined by the following claims.

The invention claimed is:

1. A base station antenna for a wireless communication system, comprising:

a ground plane;

a substantially linear array of dipole antenna elements supported by the ground plane extending in a main antenna axis direction, the array configured to emit a beam having a first polarization component defined by E(theta) and a second polarization component defined by E(phi) substantially orthogonal to the first polarization component, wherein the beam exhibits a beamwidth extending across a selected range of azimuth;

an antenna feed system configured to deliver RF signals to the antenna elements and receive RF signals from the antenna elements to generate the beam for engaging in duplex communications with a plurality of wireless communication devices utilizing an operational frequency band defined around a center frequency corresponding to a center wavelength; and a pair of beam shaping structures connected to or positioned proximate to the ground plane and positioned proximate to the antenna elements configured to influence the shape of the beam shape to exhibit desired beam shape characteristics, including:

the selected range of azimuth equal to at least 45°,

E(theta) and E(phi) each exhibiting 3 dB beamwidth across the selected range of azimuth, E(theta) and E(phi) exhibiting 3 dB drop points defining the selected range of azimuth within 5° of each other; and a polarization gain differential between E(theta) and E(phi) of not more than 3 dB across the selected range of azimuth.

2. The base station antenna of claim 1, further configured to exhibit the desired beam shape characteristics within a bandwidth range of operational frequencies defined around the center frequency equal to at least 30% of the center frequency.

3. The base station antenna of claim 1, wherein the beam shaping structures comprise a pair of inverted-L flange sections extending from the ground plane aside the array of antenna elements, wherein each flange is elongated in the main antenna axis direction, and the flanges are positioned a distance "d" apart perpendicular to the main antenna axis direction with the antenna elements located between the flanges.

4. The base station antenna of claim 3, wherein the distance "d" between the flanges is selected to control the E(theta) and E(phi) azimuth beamwidths of the antenna.

5. The base station antenna of claim 4, wherein each antenna element comprises a lateral section supported a distance "h" from the ground plane, wherein the distance "d" and the distance "h" are selected to control the E(theta) and E(phi) azimuth beamwidths of the antenna.

6. The base station antenna of claim 5, wherein:

the E(theta) and E(phi) azimuth beamwidths are about 45 degrees, the distance "d" is about 1.04 times the center wavelength, and the distance "h" is about 0.22 times the center wavelength;

the E(theta) and E(phi) azimuth beamwidths are about 65 degrees, the distance "d" is about 0.74 times the center wavelength, and the distance "h" is about 0.22 times the center wavelength;

the E(theta) and E(phi) azimuth beamwidths are about 85 degrees, the distance "d" is about 0.57 times the center wavelength, and the distance "h" is about 0.26 times the center wavelength;

the E(theta) and E(phi) azimuth beamwidths are about 90 degrees, the distance "d" is about 0.52 times the center wavelength, and the distance "h" is about 0.30 times the center wavelength; or the E(theta) and E(phi) azimuth beamwidths are about 120 degrees, the distance "d" is about 0.52 times the center wavelength, and the distance "h" is about 0.39 times the center wavelength.

7. The base station antenna of claim 1, wherein each antenna element comprises a dual polarization radiating structure configured to emit a first communication embedded in the signal first polarization component and a second communication embedded in the signal second polarization component.

8. The base station antenna of claim 7, wherein each radiating element comprises a substantially planar radiating structure positioned at an angle of about 45 degrees with respect to the main antenna axis, and each dipole antenna element comprises two substantially planar radiating elements oriented perpendicular to each other.

9. The base station antenna of claim 8, wherein each radiating element comprises a substantially T-shaped dipole comprising a riser section extending from the ground plane and a lateral section spaced distance apart from the ground plane.

10. The base station antenna of claim 1, further comprising one or more phase shifters operable for tilting the beam in an elevation angular direction perpendicular to the azimuth angular direction.

11. The base station antenna of claim 1, wherein the ground plane and beam shaping structures define a tray integrally formed into an ground plane or an enclosure supporting the antenna elements.

12. The base station antenna of claim 1, wherein the ground plane is a first ground plane, the antenna array is a first antenna array, the antenna feed system is a first antenna feed system, the beam is a first beam, the center frequency is a first center frequency, the center wavelength is a first center wavelength, the operational frequency band is a first operational frequency band, and the beam shaper is a first beam shaper, further comprising:

a second ground plane;

a substantially linear second array of antenna elements supported by the second ground plane, wherein the second array is configured to broadcast and receive RF signals in a second beam having a beamwidth defined by a first polarization component E(theta) and a second polarization component E(phi) substantially orthogonal to the first polarization component;

a second antenna feed system configured to deliver RF signals to the second array of antenna elements and receive RF signals from the second array of antenna elements to generate the second beam for engaging in duplex communications with a plurality of mobile telephone devices utilizing a second operational frequency band defined around a second center frequency corresponding to a second center wavelength;

a second beam shaper extending from the ground plane having a shape configured to influence the second beam to exhibit performance characterized by a gain differential between E(phi) and E(theta) that is no more than 3 dB across the second operational frequency band, wherein the second operational frequency band is equal to at least about thirty percent of the second center frequency.

13. The base station antenna of claim 12, wherein the first ground plane, the first beam shaper, the second ground plane and the second beam shaper define a two-tray ground structure integrally formed into an enclosure housing the antenna feed system.

14. The base station antenna of claim 12, further comprising:

a third ground plane;

a third substantially linear array of antenna elements supported by the third ground plane, wherein the third array is configured to broadcast and receive RF signals in a third beam having a beamwidth defined by a first polarization component E(theta) and a second polarization component E(phi) substantially orthogonal to the first polarization component;

a third antenna feed system supported by the ground plane configured to deliver RF signals to the third array of antenna elements and receive RF signals from the third array of antenna elements to generate the third beam for engaging in duplex communications with a plurality of mobile telephone devices utilizing a third operational frequency band defined around a third center frequency corresponding to a third center wavelength;

a third beam shaper extending from the ground plane having a shape configured to influence the third beam to exhibit performance characterized by a gain differential between E(phi) and E(theta) that is no more than 3 dB across the third operational frequency band, wherein the third operational frequency band is equal to at least about thirty percent of the third center frequency.

15. The base station antenna of claim 13, wherein the first ground plane, the first beam shaper, the second ground plane, the second beam shaper, the third ground plane and the third beam shaper define a three-tray ground structure integrally formed into an enclosure housing the antenna feed system.

* * * * *